US006592498B1

(12) United States Patent
Trainor

(10) Patent No.: US 6,592,498 B1
(45) Date of Patent: Jul. 15, 2003

(54) EXERCISE DEVICES

(76) Inventor: Patrick John Trainor, Cuckoo Cottage, Darby Green, Blackwater, Camberley, Surrey GU17 OAS (GB)

( * ) Notice: Subject to any disclaimer, the term of this patent is extended or adjusted under 35 U.S.C. 154(b) by 0 days.

(21) Appl. No.: 09/383,728

(22) Filed: Aug. 26, 1999

Related U.S. Application Data

(63) Continuation of application No. PCT/GB98/00844, filed on Mar. 20, 1998.

(30) Foreign Application Priority Data

Mar. 21, 1997 (GB) ..... 9705877
Aug. 28, 1998 (GB) ..... 9818888

(51) Int. Cl.[7] ..... A63B 21/08
(52) U.S. Cl. ..... 482/97; 482/50; 482/46; 482/93; 482/98
(58) Field of Search ..... 482/137, 96, 97, 482/95, 93, 112, 133–135, 98, 138, 129, 130, 142

(56) References Cited

U.S. PATENT DOCUMENTS

| | | | | |
|---|---|---|---|---|
| 3,345,067 A | * | 10/1967 | Smith | 482/21 |
| 4,036,490 A | | 7/1977 | Rice | |
| 4,620,703 A | | 11/1986 | Greenhut | |
| 4,623,144 A | | 11/1986 | Rockwell | |
| 4,629,185 A | | 12/1986 | Amann | |
| 4,640,268 A | | 2/1987 | Roberts | |
| 4,898,381 A | | 2/1990 | Gordon | |
| 5,011,142 A | | 4/1991 | Eckler | |
| 5,407,405 A | | 4/1995 | Oren | 482/50 |
| 5,447,480 A | | 9/1995 | Fulks | |
| 5,451,194 A | | 9/1995 | Harrigan | 482/70 |
| 5,509,878 A | | 4/1996 | Denega et al. | 482/110 |
| 6,113,522 A | * | 9/2000 | Fontenot et al. | 482/112 |

FOREIGN PATENT DOCUMENTS

| | | | |
|---|---|---|---|
| DE | 2900204 | 7/1980 | A63B/69/18 |
| GB | 2131308 | 11/1983 | A63B/21/00 |
| WO | WO 88/01526 | 3/1988 | A63B/69/36 |
| WO | WO 89/02295 | 3/1989 | A63B/21/00 |
| WO | WO 92/07628 | 5/1992 | A63B/21/06 |

* cited by examiner

*Primary Examiner*—Jerome W. Donnelly
(74) *Attorney, Agent, or Firm*—Clifford W. Browning; Woodard, Emhardt, Moriarty, McNett & Henry LLP

(57) ABSTRACT

Exercise devices which are arranged to replicate the feel and effect of exercising with free weights but providing resistance in two directions away from a null position are disclosed. One example of a device comprises a handle 1021 which can be grasped by an exerciser and which is mounted on an articulated arm portion 1002 which in turn is mounted to a frame 1005. A weight 1031, lever arm 1032 and hydraulic transmission means provide resistance to movement. A first arm member 1022 is pivotally mounted to allow pivotal movement about an axis. Pivotal movement about this axis in two directions away from a null position is resisted by the weight 1031. The weight 1031 also tends to urge the arm member 1022 back towards the null position. The null position can be adjusted using the hydraulic arrangement.

31 Claims, 28 Drawing Sheets

EXERCISE DEVICES

This application is a continuation of international application number PCGB98/00844, filed Mar. 20, 1998.

This invention relates to exercise devices, in particular exercise devices which can be used to allow a number of different exercises to be carried out while in a gymnasium or at home, for example. The possible exercises may include a very wide range of exercises covering all muscle groups.

There are generally two options available for exercising specific muscle groups. The first is to use free weights in an appropriate manner, and the second is to use a specific machine arranged to allow the performance of a particular exercise designed to target that muscle group.

A major advantage of free weight training is that it allows the user maximum freedom to exercise against a selected resistance in any manner chosen. The user is however confined to working against gravity. No resistance can be provided when moving the weights in a downwards direction. In contrast to this, existing machines can provide resistance against movement in both upward and downward directions but are generally constructed in such a way to allow only very specific exercises to be carried out at any given machine. Even, in machines which are intended to allow a variety of exercises to be carried out, the range of movements available is limited.

WO 92/07628 discloses limb movement and training apparatus which can provide resistance to a complex pattern of movement but, with any given configuration, resistance is only provided in one general direction away from a rest position and there is no freedom to move in any other directions.

WO 89/02295 discloses a multidirectional exerciser in which a user grasps a handle and resistance to motion in both senses about three independent axes is provided.

It is an object of this invention to provide an exercise device in which at least some of the disadvantages of free weights and/or existing exercising machines are alleviated.

According to a first aspect of the present invention there is provided an exercise device comprising at least one exercising unit;

the or each exercising unit comprising:

a moveable member against which effort of an exerciser can be exerted; and resistance means for providing resistance to movement of the moveable member, characterised in that the moveable member has a null position and the resistance means is arranged to resist movement of the moveable member in two directions away from the null position and to cause or allow substantially without resistance, return of the moveable member to the null position.

Preferably the resistance means comprises transmitting means for transmitting a load to be worked against from loading means to the moveable member.

Preferably the resistance means is arranged to resist movement of the arm member along only one locus or about only one axis, movement in other loci and/or about other axes being substantially unresisted.

According to a second aspect of the present invention there is provided an exercise device comprising at least one exercising unit;

the or each exercising unit comprising:

a moveable member against which effort of an exerciser can be exerted, the moveable member being moveable towards and away from a rest position parallel to a loading direction, and resistance means for providing resistance to movement of the moveable member, comprising loading means and transmitting means arranged to apply a force to be worked against to the moveable member in the loading direction when the moveable member is displaced from the rest position in a direction opposite to the loading direction, characterised in that the moveable member is moveable in directions which are not substantially parallel to the loading direction, the resistance means being arranged so that movement in such directions is substantially unresisted.

According to a third aspect of the present invention there is provided an exercise device comprising at least one exercising unit;

the or each exercising unit comprising:

a moveable member against which effort of an exerciser can be exerted, the moveable member being moveable in any direction and having a rest position; and resistance means for providing resistance to movement of the moveable member, characterised in that the resistance means comprises loading means and transmitting means arranged to apply a force to be worked against to the moveable member in a loading direction when the moveable member is displaced from the rest position in a direction opposite to the loading direction; and the resistance means is arranged so that there is substantially no resistance to movement of the moveable member in directions which are not substantially parallel to the loading direction.

Preferably the rest position is a null position and the resistance means is arranged to resist movement of the moveable member in two directions away from the null position and to cause or allow substantially without resistance, return of the moveable member to the null position.

Preferably the resistance means is arranged to urge the moveable member towards the null position when the moveable member is displaced from the null position.

Preferable means for adjusting the null position are provided.

The transmitting means may be arranged to transmit movement of the moveable member to the loading means.

The transmitting means may comprise a hydraulic arrangement.

The hydraulic arrangement may comprise a hydraulic arm cylinder which is operable, by movement of the moveable member, to cause hydraulic fluid to be supplied to a second hydraulic cylinder, which is associated with the loading means, so that movement of the moveable member causes the second hydraulic cylinder to be operated.

The resistance means can comprise a weight and pulley arrangement such that in use gravity acting on the weight provides resistance to movement of the moveable member.

The resistance means can comprise a weight mounted on a pivotally moveable weight bearing member and be arranged so that gravity acting on the weight provides the resistance to movement of the moveable member.

The moveable member may be slidably mounted on at least one guide member and the resistance means may be arranged to resist sliding movement.

The moveable member may comprise a grip member and an arm member, the grip member being mounted to the arm member in such a way that pivotal movement of the grip member about its centre of mass is substantially unresisted.

Preferably the exercise device further comprises an arm portion comprising a grip member and an arm member, the grip member being mounted to the arm member so as to allow the grip member to pivot, substantially without resistance, relative to the arm member, the moveable member comprising the grip member and the arm member.

Preferably the grip member is mounted to the arm member so as to allow the grip member to pivot about two mutually perpendicular axes relative to the arm member.

The arm portion may be an articulated arm portion comprising two arm members which are pivotally connected to one another.

Preferably at least one member of the arm portion is arranged to be pivotable about an axis and the resistance means is arranged to resist pivotal movement about that axis.

The exercise device can be arranged so that the magnitude of the effort which must be exerted at the grip member against the force applied to the moveable member does not, within the operational range of the moveable member, vary significantly as the grip member and arm member as a unit are moved to any position which is displaced, in the loading direction, from the rest position.

The exercise device can be arranged so that the magnitude of the effort which must be exerted at the grip member in a predetermined linear direction against the force applied to the moveable member does not, within the operational range of the moveable member, vary significantly as the grip member and arm member as a unit are moved to any position which is displaced, in the loading direction, from the rest position.

Preferably the loading direction comprises a substantially linear path.

The loading direction may comprise an arcuate path.

Preferably the grip member and arm member as a unit is pivotally mounted about an axis and movement about that axis constitutes movement parallel to the loading direction.

Preferably the arm portion is arranged so that the grip member can follow a substantially linear path throughout the operational range of the moveable member as the arm member and grip member as a unit are moved in the loading direction around said axis.

In alternatives the resistance means may comprise a take up means to which one end of a load bearing member is attached; and the loading means can be arranged to apply a load to the load bearing member to resist movement thereof;

the transmitting means can be arranged to transmit movement of the moveable member to the take up means to cause the take up means to move; and the resistance means can be arranged so that when the moveable member is moved in a first direction away from the null position, the take up means operates so that the load bearing member is pulled around the take up means in one direction against the load and when the moveable member is moved in a second direction away from the null position, the take up means operates so that the load bearing member is pulled around the take up means in an opposite direction against the load, whereby movement of the moveable member in both the first and the second directions away from the null position is resisted.

The transmitting means may comprise a pulley arrangement comprising a plurality of fixed pulley wheels, a pair of floating pulley wheels and an endless elongate flexible member which is provided around the fixed pulley wheels and to which the moveable member is connected, the pair of floating pulley wheels being supported by the flexible member and connected to the take up means, the pulley arrangement being such that when the moveable member is moved in the first direction the pair of floating pulley wheels move in one direction and when the moveable member is moved in the second direction the pair of floating pulley wheels move in another direction.

Preferably the take up means comprises a drum and the resistance means is arranged so that when the moveable member is moved in the first direction away from the null position, the drum is rotated in a first sense so that the load bearing member is wound around the drum in one direction against the load and when the moveable member is moved in the second direction away from the null position, the drum is rotated in an opposite sense so that the load bearing member is wound around the drum in an opposite direction against the load.

Alternatively the take up means comprises an endless flexible member disposed around means to restrict its path and the resistance means is arranged so that when the moveable member is moved in the first direction away from the null position, the flexible member is moved in one direction so that the load bearing member is pulled around the path in said one direction against the load and when the moveable member is moved in the second direction away from the null position, the flexible member is moved in an opposite direction so that the load bearing member is pulled around the path in the opposite direction against the load.

The means to restrict the path of the first endless flexible member can comprise a plurality of fixed pulley wheels and a block comprising a pair of pulley wheels. Preferably means for moving the block between a plurality of different positions are provided. Means for locking the block in each of the different positions can be provided. Preferably, the path of the first flexible member is adjustable by moving the block between the plurality of different positions. This arrangement can allow the null position to be adjusted.

The load bearing member can comprise two ends which are remote from the load, both these ends being connected to the take up means. Preferably the ends are connected to the take up means at distinct locations. These locations can be chosen so that a portion of the load bearing member associated with one of the ends will remain in tension when the moveable member or arm portion is moved in one direction away from the null position and a portion of the load bearing member associated with the other of the ends will remain in tension when the moveable member or arm portion is moved in the other direction away from the null position.

Preferably the transmitting means comprises a pulley arrangement comprising a plurality of fixed pulley wheels, a pair of floating pulley wheels and a second endless elongate flexible member which is provided around the fixed pulley wheels and to which the arm portion or other resistance member is connected, the pair of floating pulley wheels being supported by the flexible member and connected to the take up means, the pulley arrangement being such that when the arm portion or moveable member is moved in the first direction the pair of floating pulley wheels move in one direction and when the arm portion or moveable member is moved in the second direction the pair of floating pulley wheels move in another direction.

The first and second flexible members can each be a continuous loop of, for example, chain, belt, strap, cable or wire. The drum can comprise a pulley wheel.

The moveable member or the arm portion can be slidably mounted on one or more guide member. This can have the effect of restricting the movement of the resistance member or the arm portion to a particular path.

The or each guide member can be a rail or a pillar.

The or each guide member may be arranged horizontally or vertically.

The transmitting means can comprise a continuous loop chain for driving the drum. Two spaced chain wheels can be provided and the loop chain can be passed around the two chain wheels. One of the chain wheels can be arranged to be rotatable about the same axis as the drum. Said one of the chain wheels and the drum can be locked against relative rotation. Said one of the chain wheels can be engageable and disengageable to the drum by means of a clutch. This can allow the null position to be adjusted.

The moveable member can comprise a sleeve which is slidably mounted on a guide member. The transmitting means can further comprise a tab mounted on the sleeve and connected to the loop chain. With this arrangement the transmitting means can transmit motion of the moveable member along the guide member to the loop chain and hence to the drum.

The moveable member can be pivotally and/or slidable mounted to the sleeve.

A parallelogram assembly can be provided to allow movement of the moveable member in a particular plane or a particular set of planes. The transmitting means can further comprise a rod mounted on one member of the parallelogram assembly and connected to the loop chain. With this arrangement the transmitting means can transmit motion of the moveable member allowed by the parallelogram assembly to the loop chain and hence to the drum.

The moveable member or the arm portion can comprise a pivotable member, the pivotal movement of which is resisted by the resistance means. A following member can be provided for reproducing the movement of the pivotable member. The transmitting means can comprise a rod mounted on the following member and connected to the loop chain. With this arrangement the transmitting means can transmit motion of the pivotable member to the loop chain and hence to the drum.

The transmitting means can further comprise a chain and chain wheel arrangement for causing the following member to reproduce the movement of the pivotable member.

A point of connection between the rod or the tab and the loop chain can be adjustable. This provides an alternative way of adjusting the null position.

According to a fourth aspect of the present invention there is provided an exercise system comprising a plurality exercise devices each of which comprises at least one exercising unit;

each exercising unit comprising a moveable member against which effort of an exerciser can be exerted and resistance means for providing resistance to movement of the moveable member, the resistance means comprising loading means for providing a load for an exerciser to work against and hydraulic transmitting means for transmitting movement of the moveable member to the loading means, characterised in that said loading means comprise a common loading means to which the hydraulic transmitting means of each exercise device is connected so that a single common loading means provides the load required to resist movement of the moveable members of a plurality of exercise devices.

According to a fifth aspect of the present invention there is provided an exercise system comprising a plurality exercise devices according to any of the preceding aspects of the present invention each of which comprises at least one exercising unit;

the resistance means of each exercise device comprising loading means for providing a load for an exerciser to work against and hydraulic transmitting means for transmitting movement of the moveable member to the loading means, characterised in that said loading means comprise a common loading means to which the hydraulic transmitting means of each exercise device is connected so that a single common loading means provides the load required to resist movement of the moveable members of a plurality of exercise devices.

Accordingly a device may be provided in which the main advantages of free weights are included and expanded upon and into which the major advantages of weight training machines are incorporated without including the restrictions normally associated with these machines.

Several forms of exercise device will now be described, by way of example, with reference to the accompanying drawings in which.

Figure 4A:
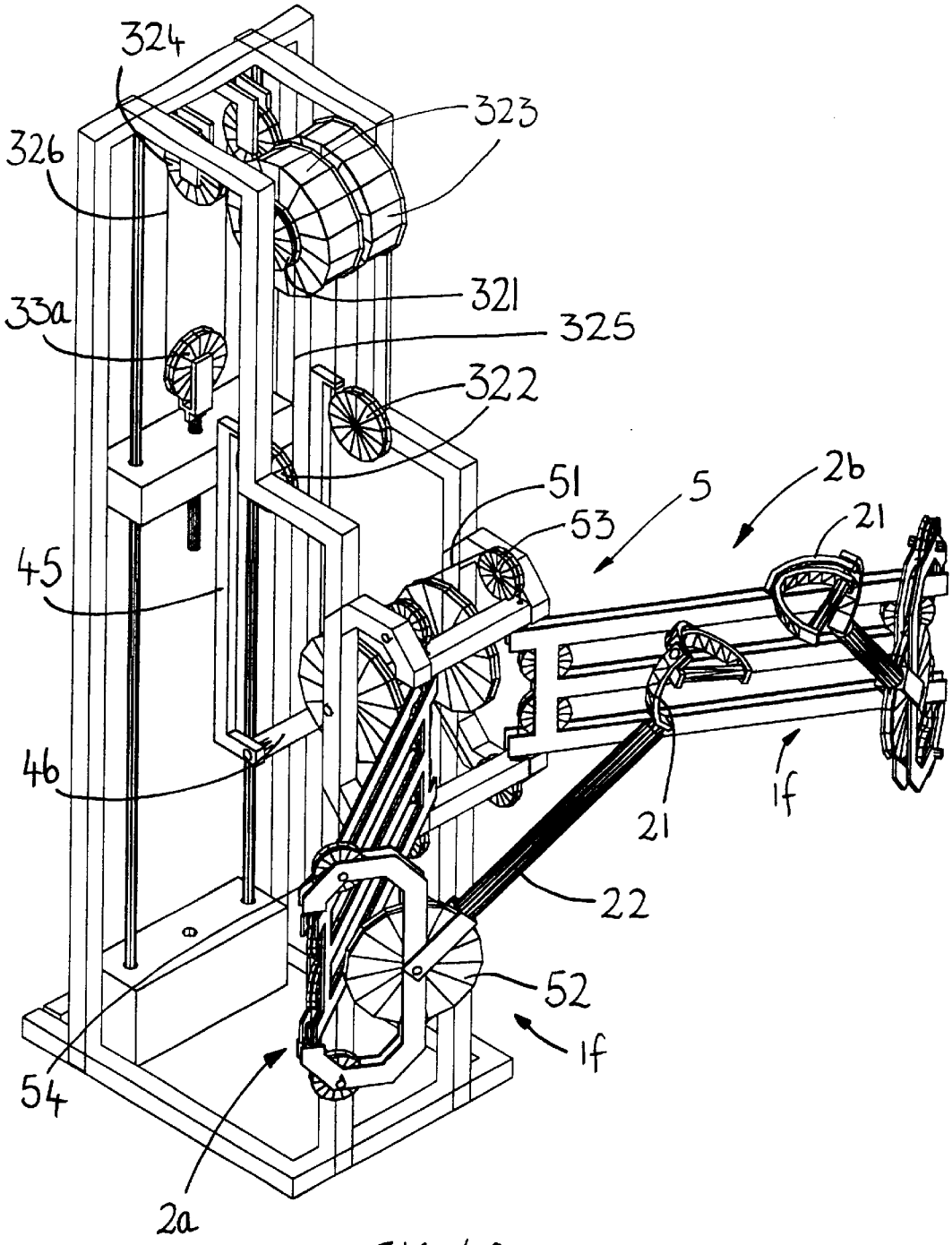
Figure 4B:
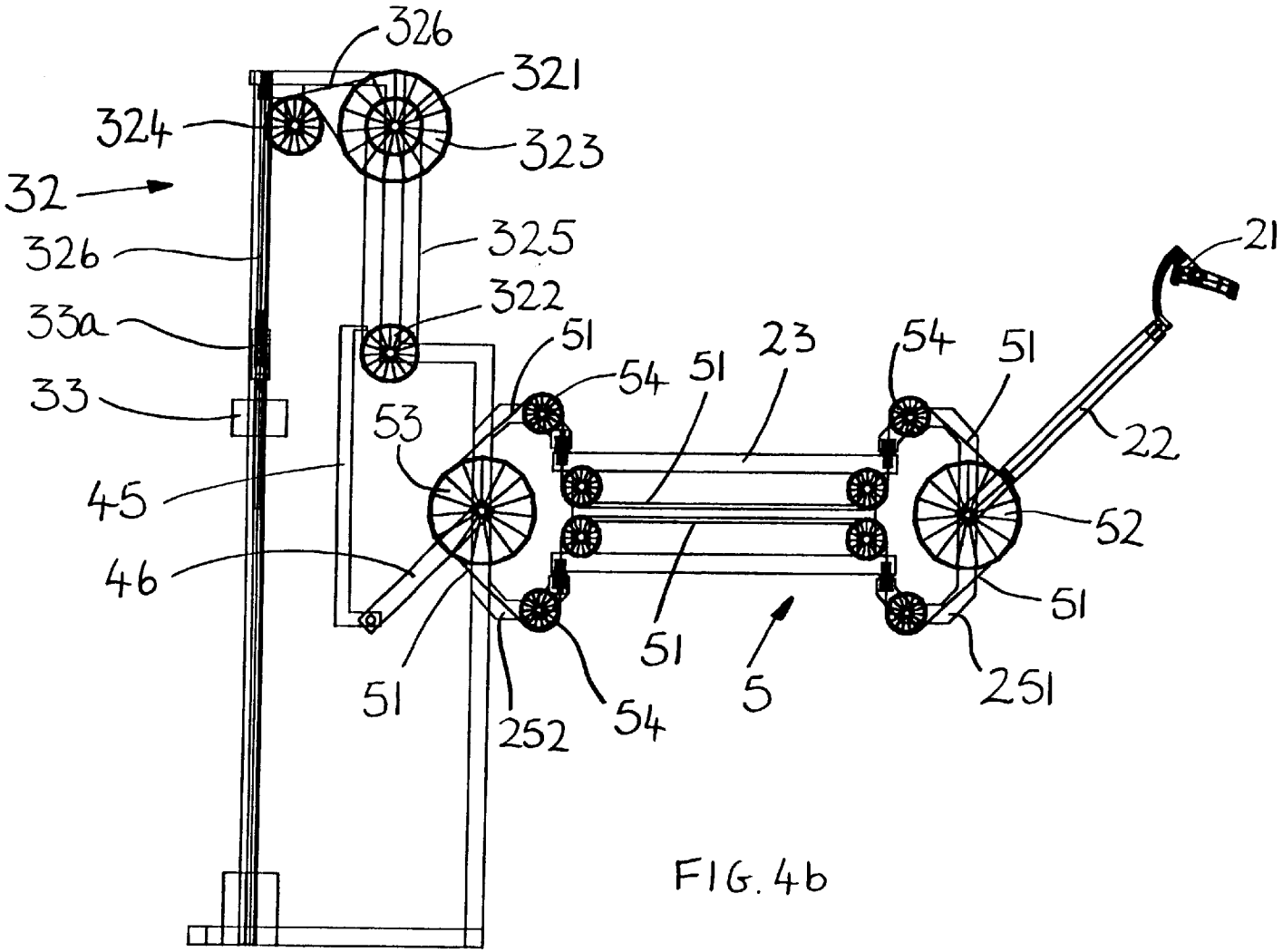
Figure 5:
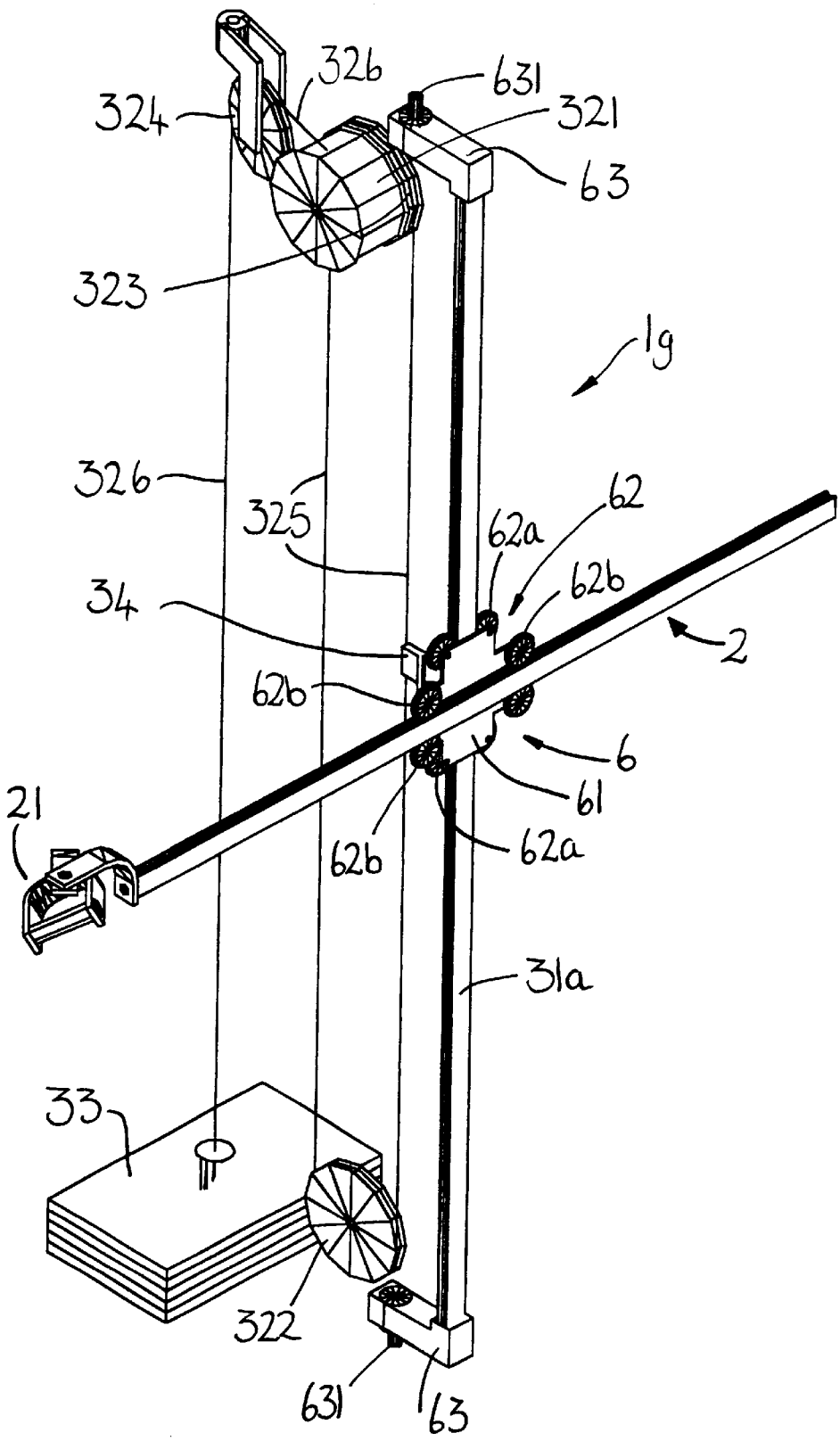
Figure 6A:
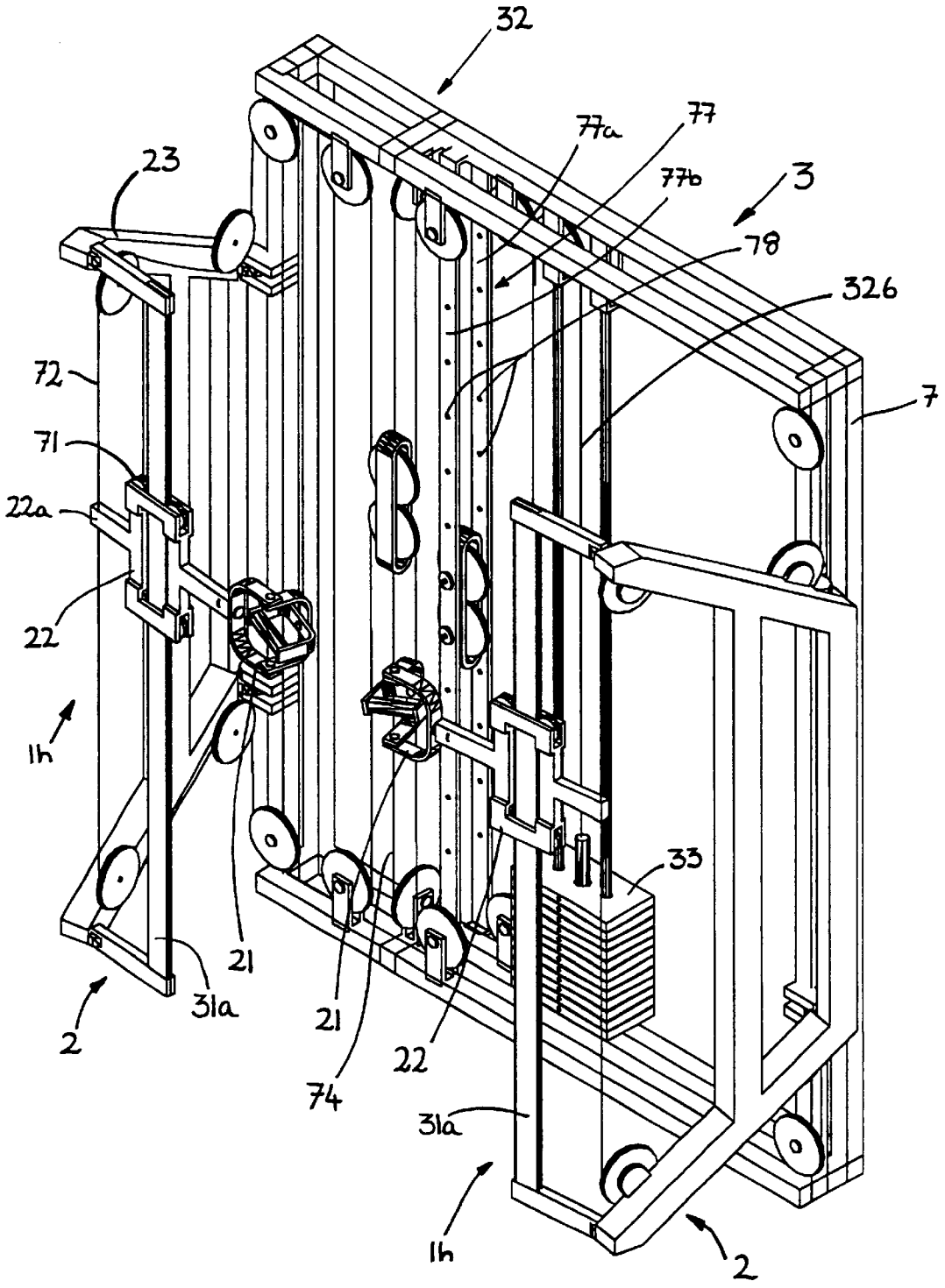
Figure 6B:
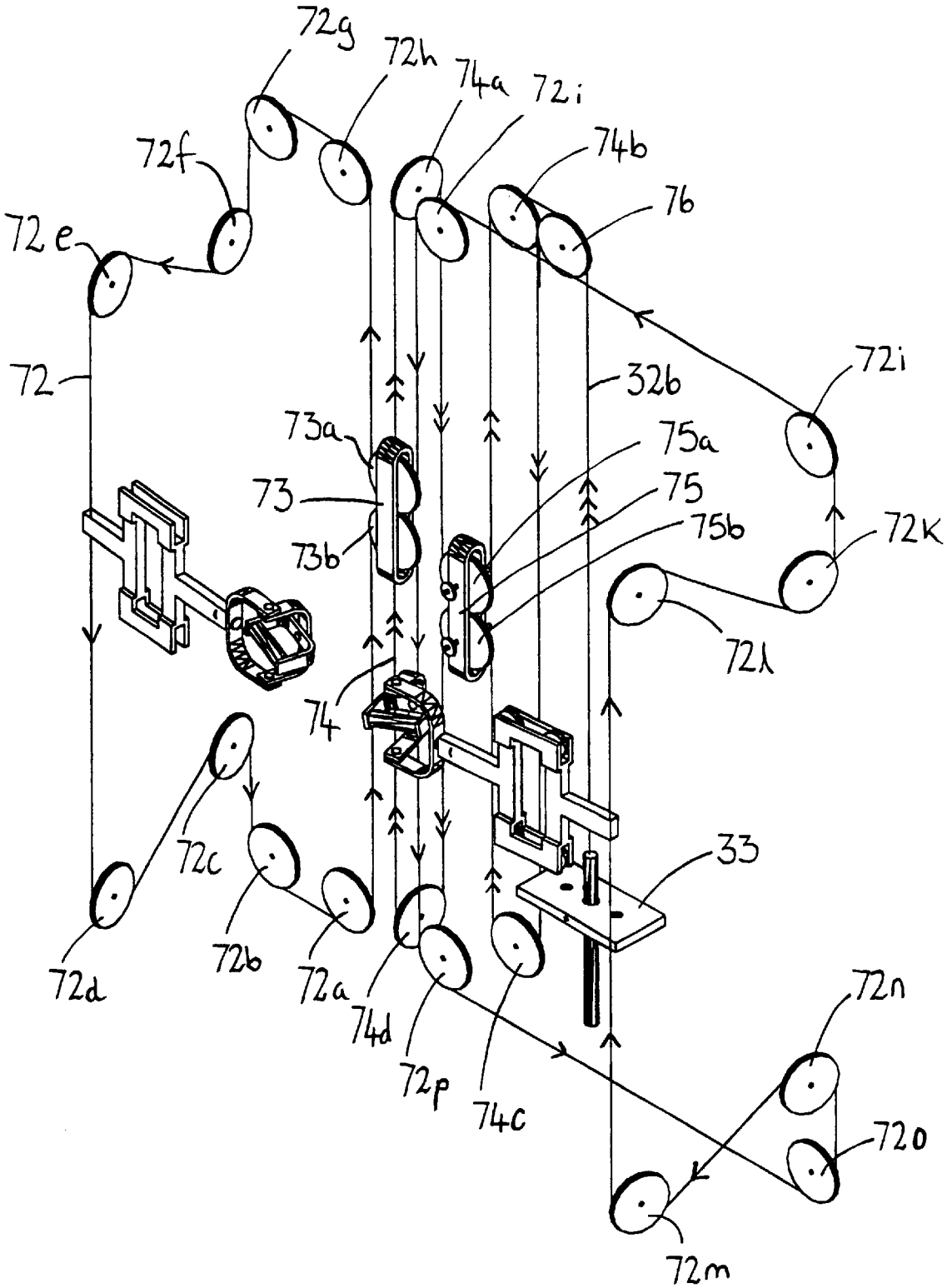

FIG. 4*a* is a perspective view of a fourth exercise device;

FIG. 4*b* is a cut-away side view of a fourth exercise device shown in FIG. 4*a* showing a cable and cable wheel arrangement;

FIG. 5 is a perspective view of an exercising unit of a fifth exercise device; and FIG. 6*a* is a perspective view of a sixth exercise device;

FIG. 6*b* is a perspective view of the pulley arrangement of a sixth exercise device shown in FIG. 6*a*.

Figure 6C:
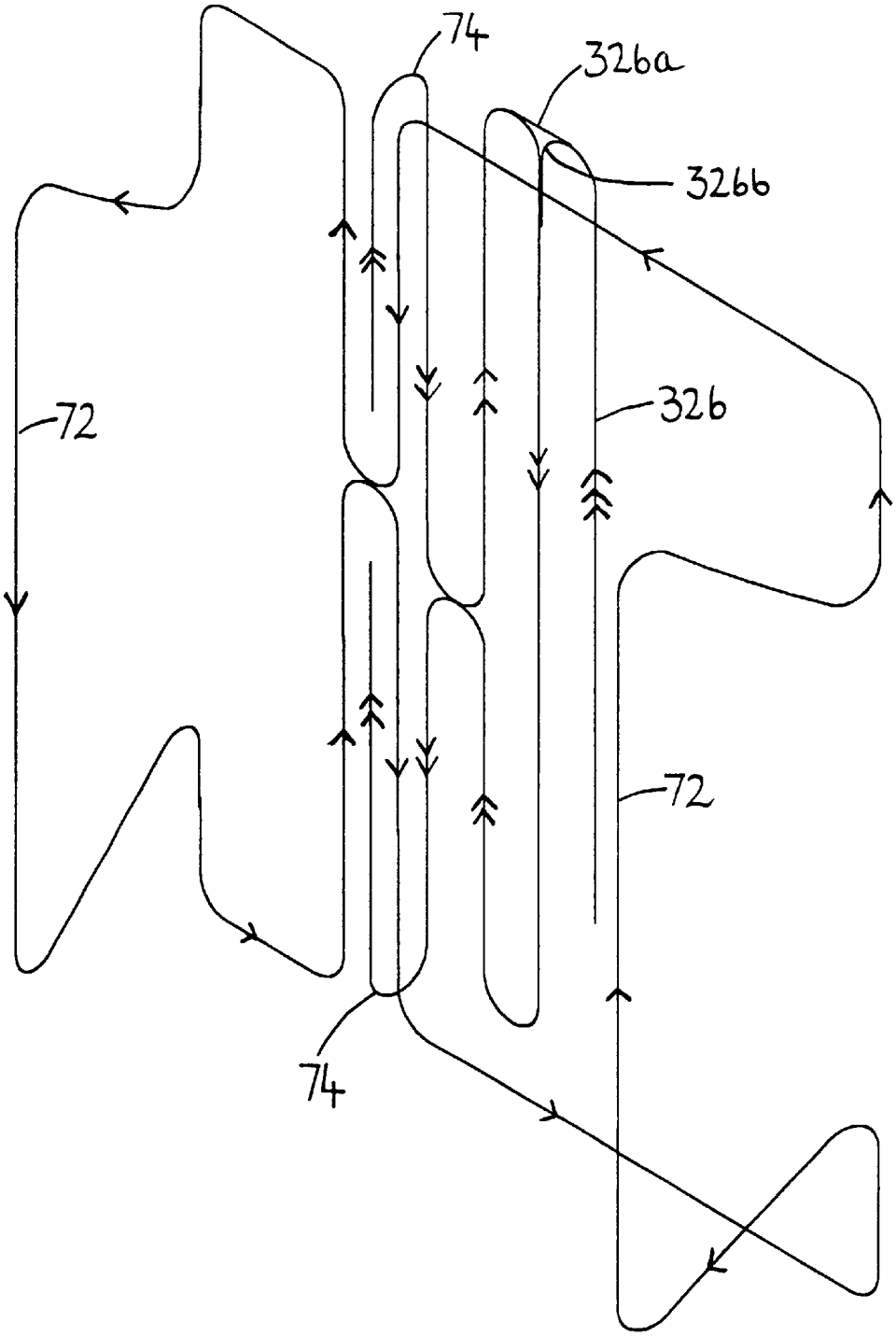

FIG. 6*c* is a perspective view of the wire and belt arrangement of the sixth exercise device shown in FIG. 6*a;*

Figure 6D:
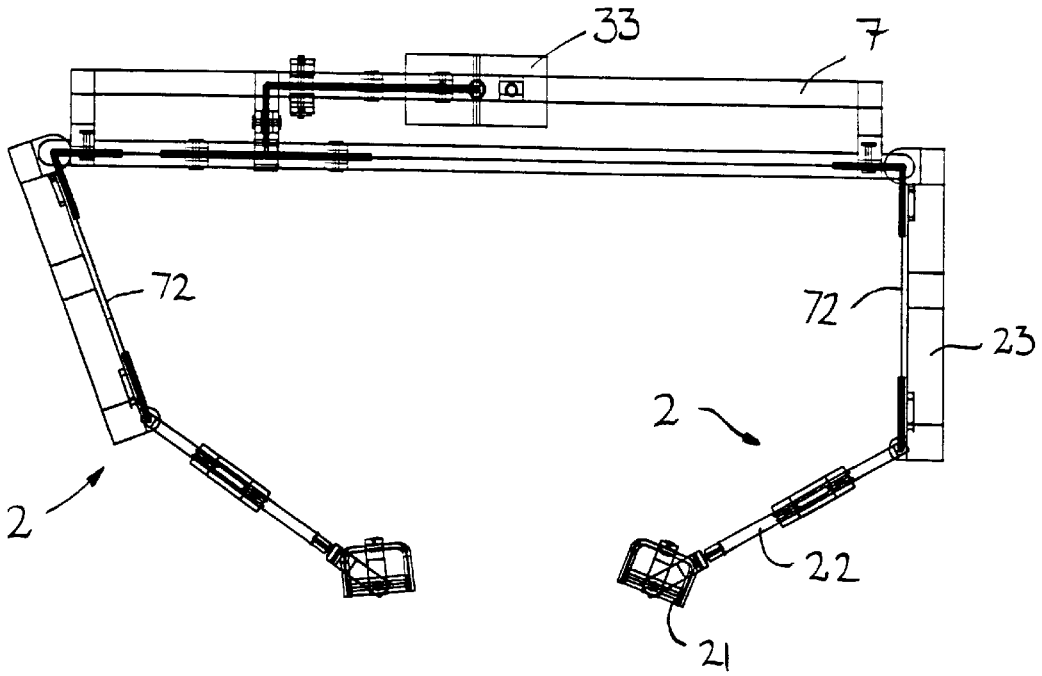
Figure 6E:
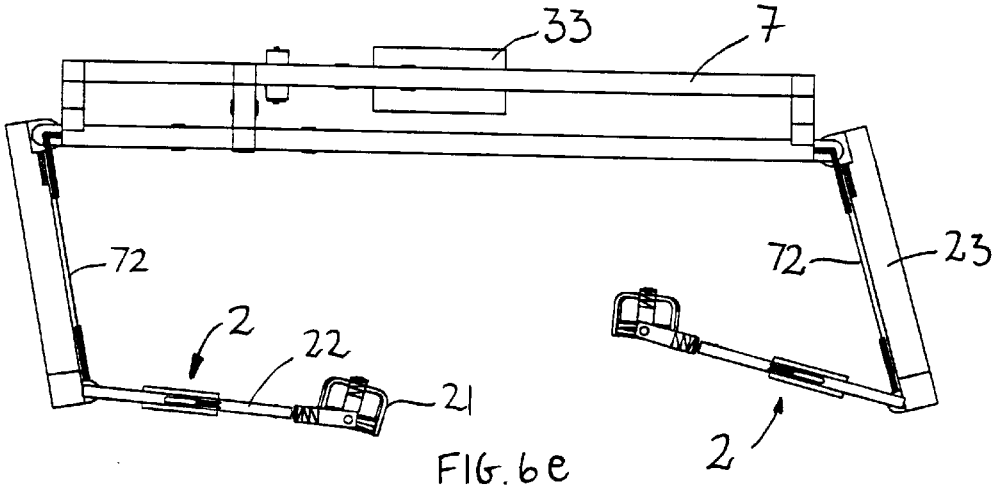
Figure 7:
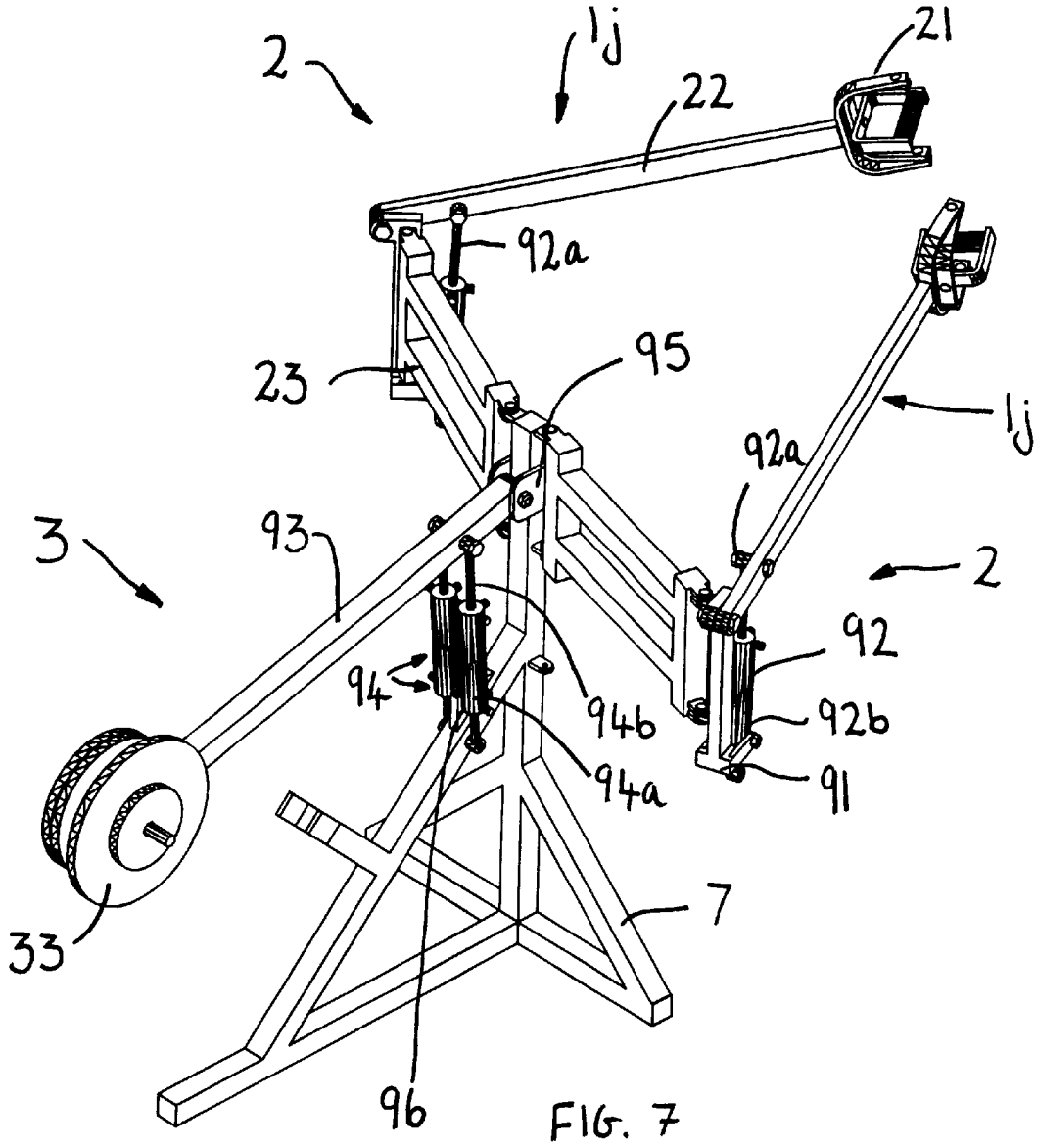
Figure 8:
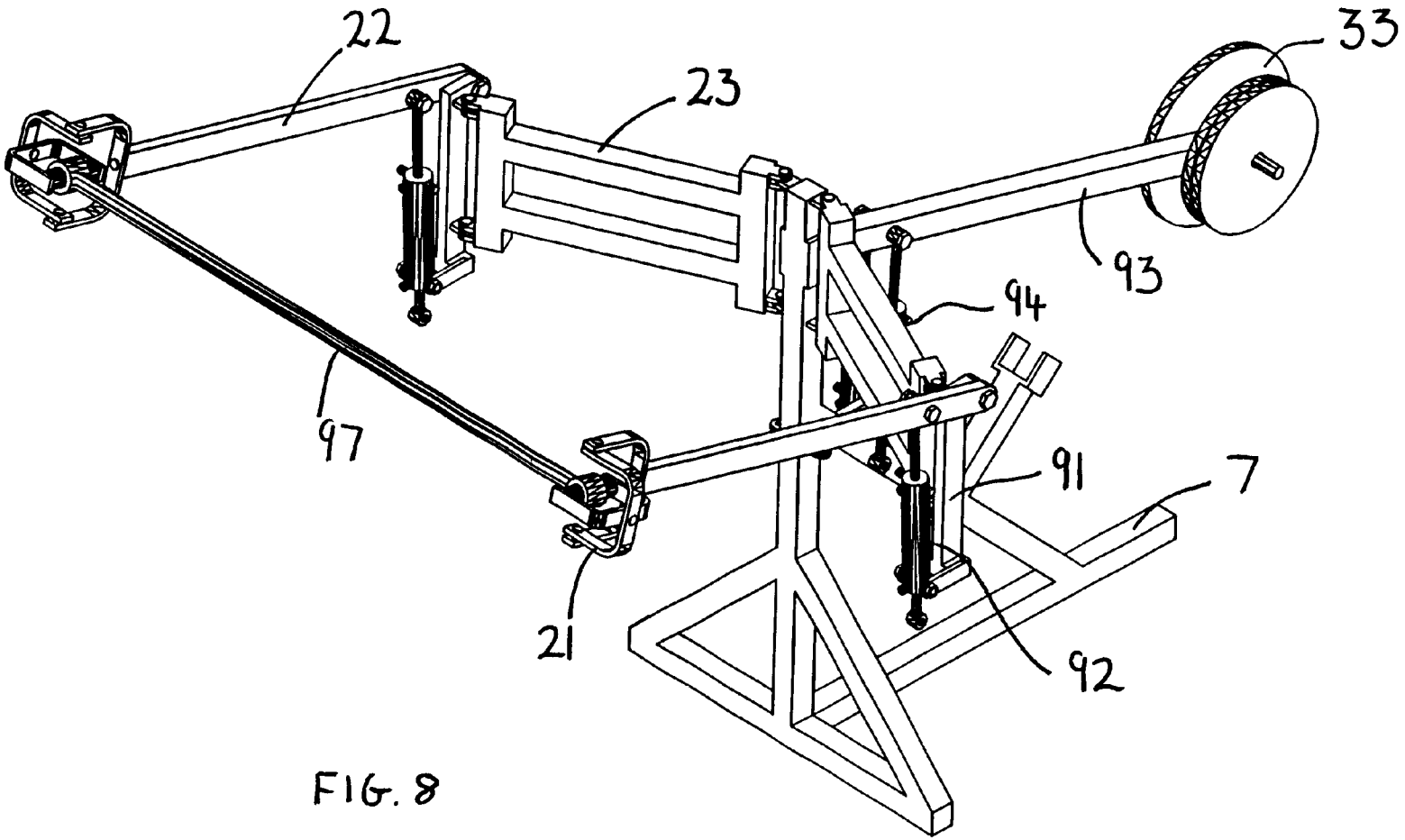
Figure 9:
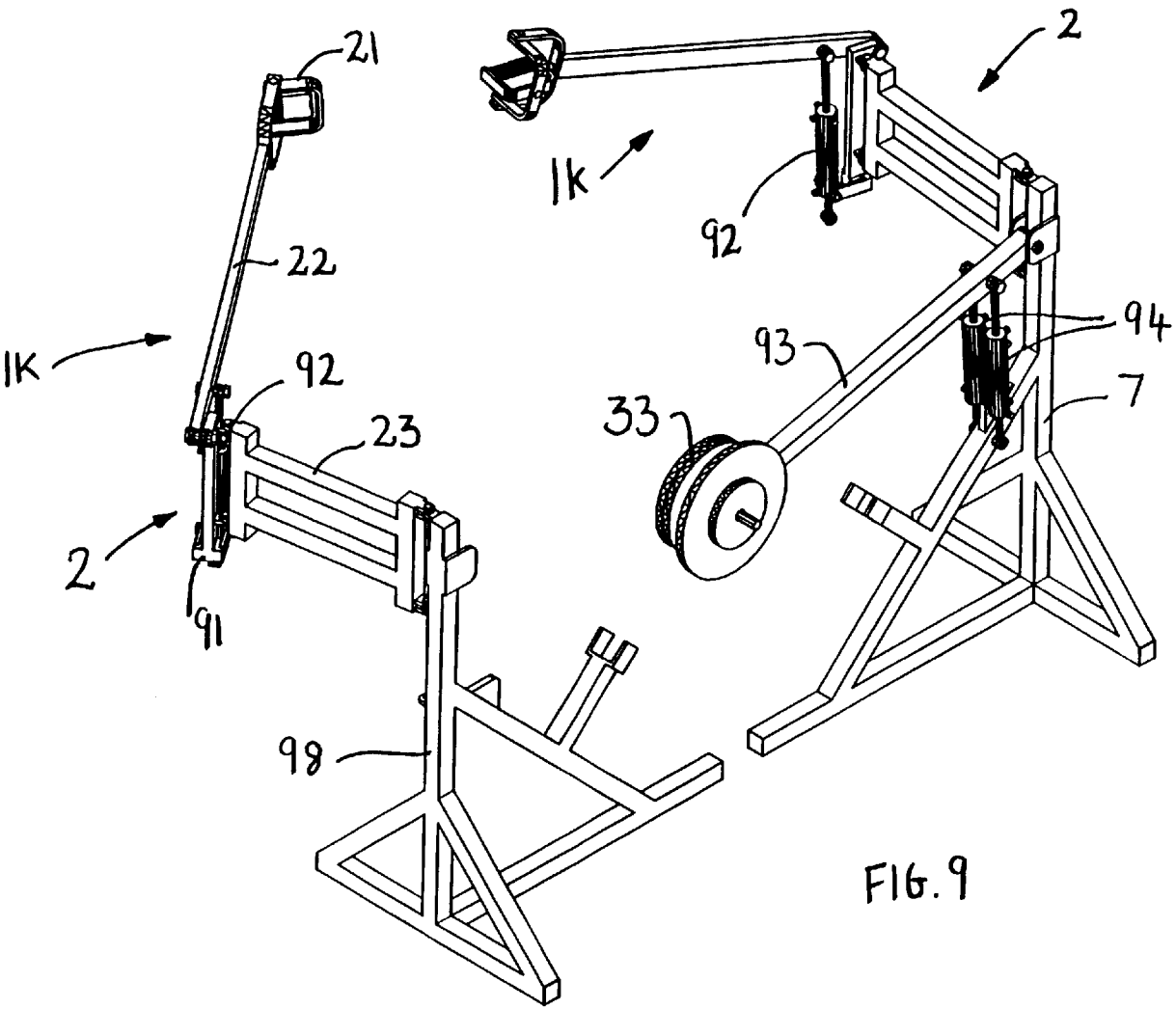
Figure 10:
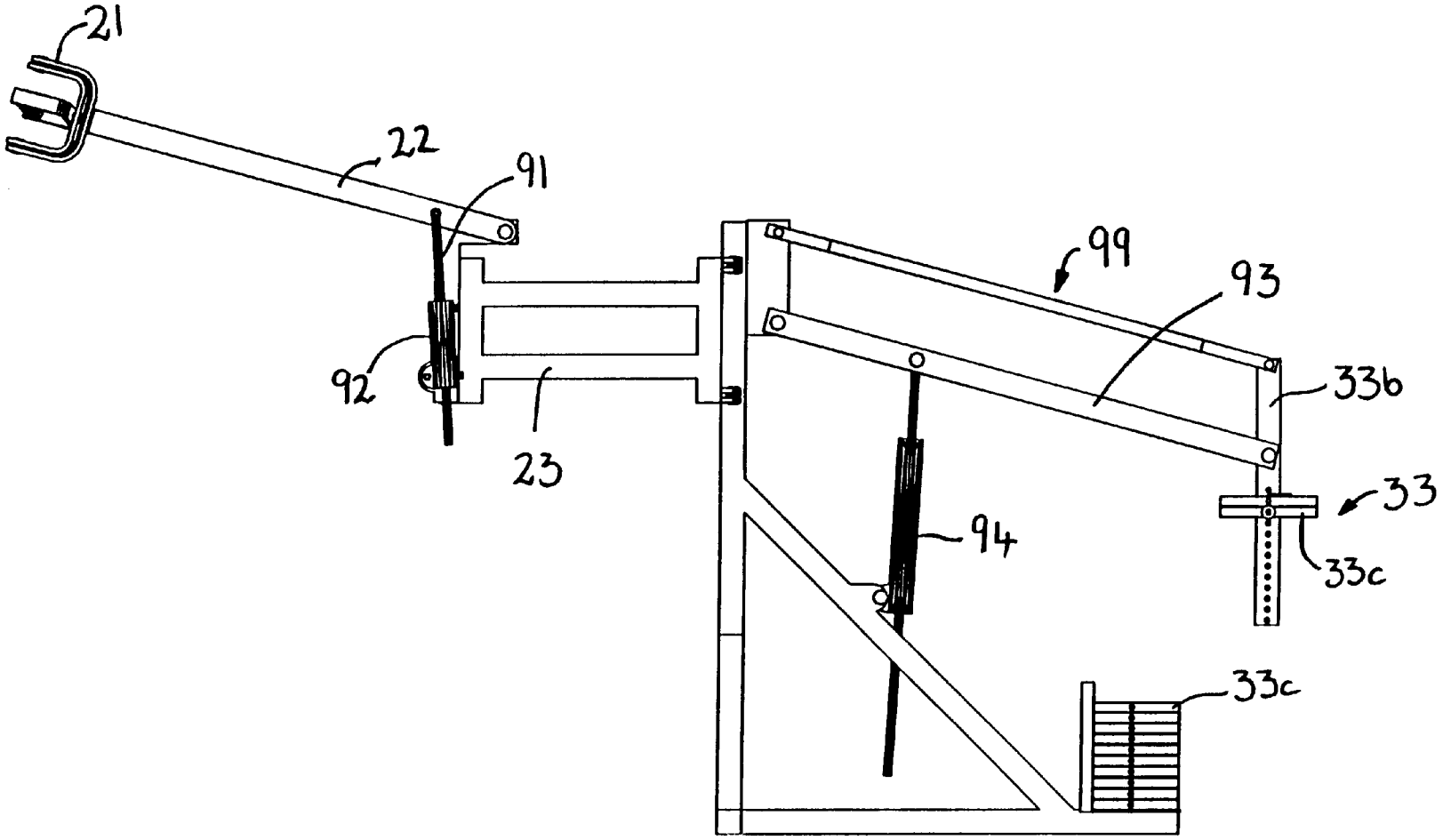
Figure 11:
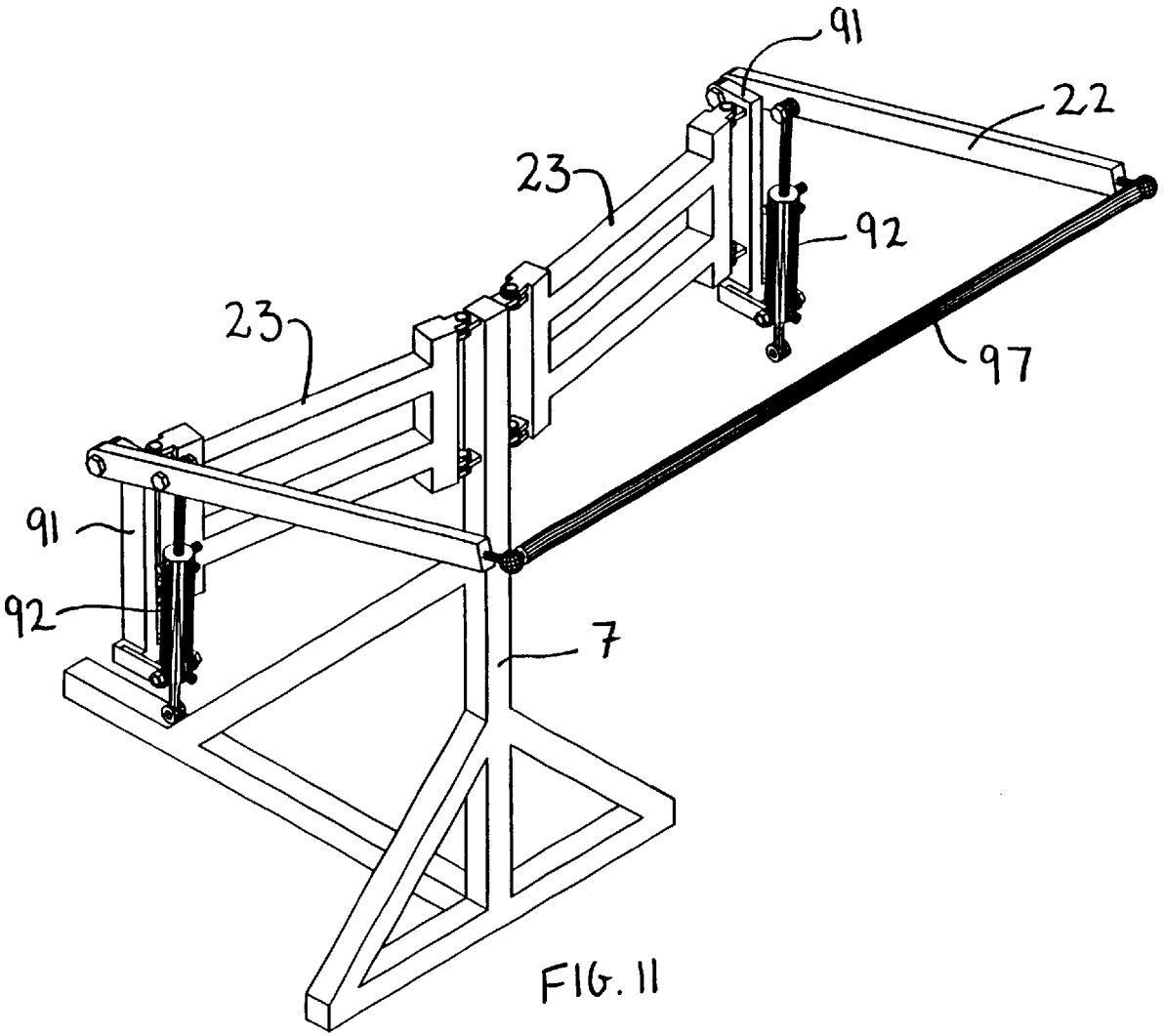
Figure 12:
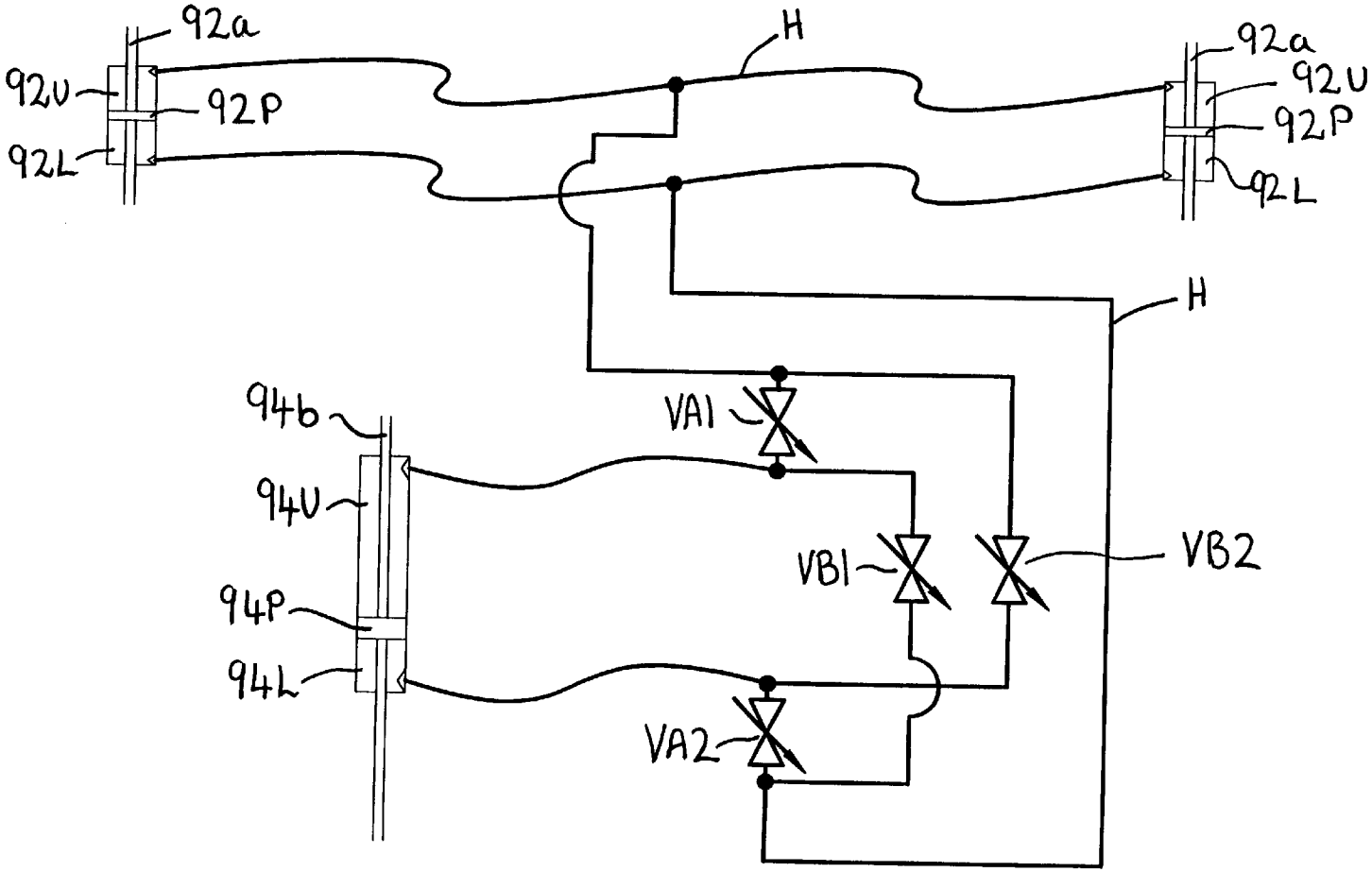
Figure 13:
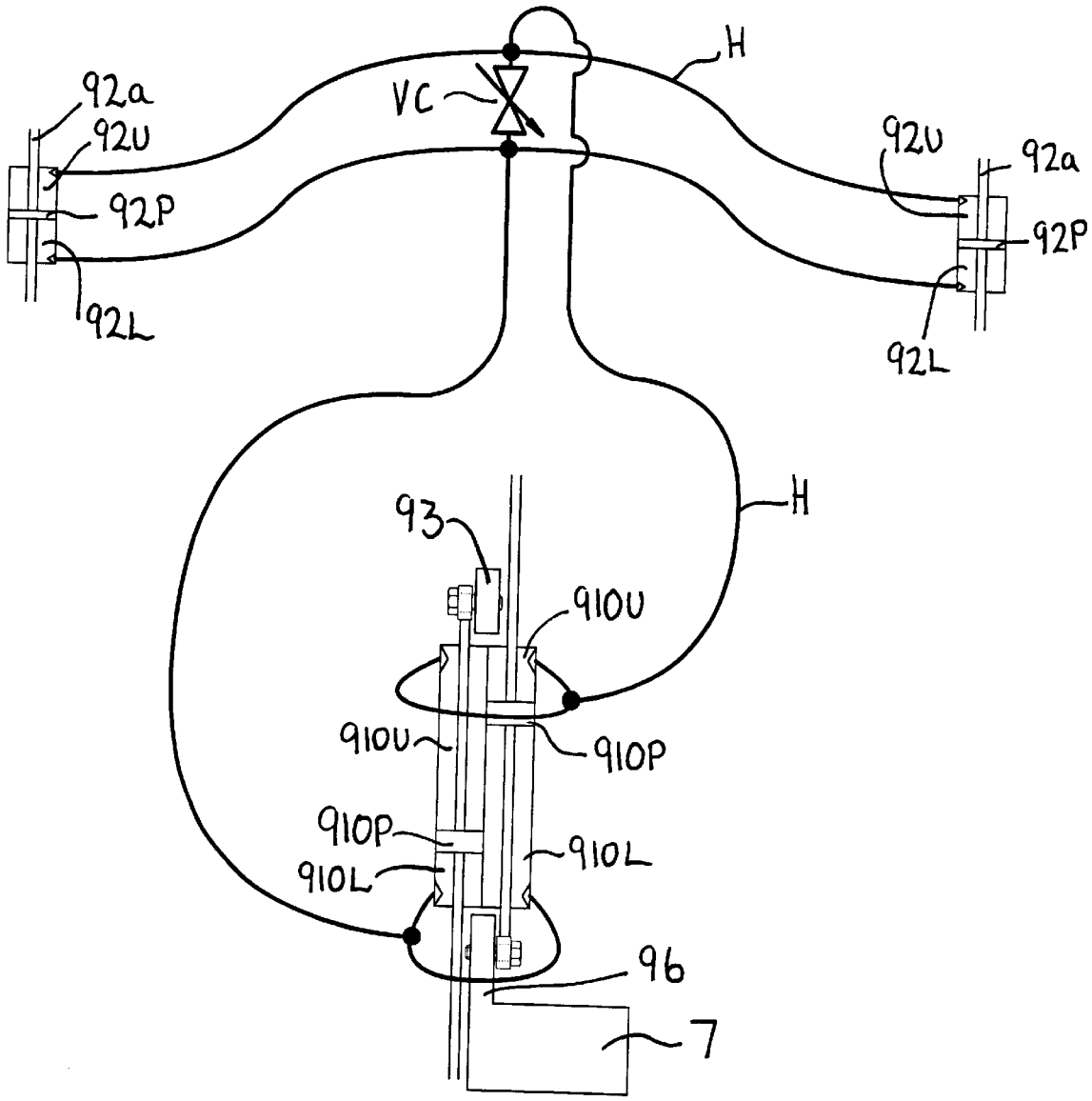
Figure 14:
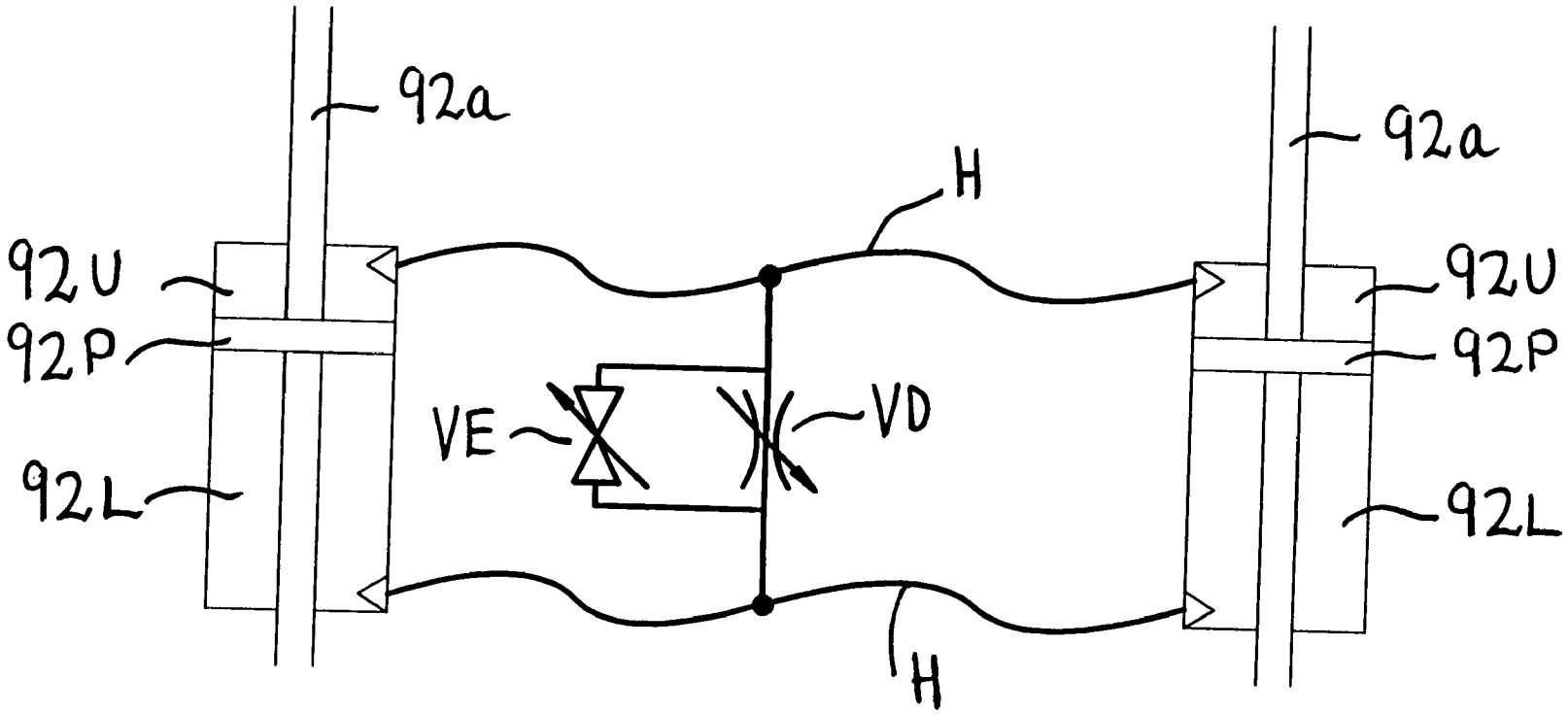
Figure 16:
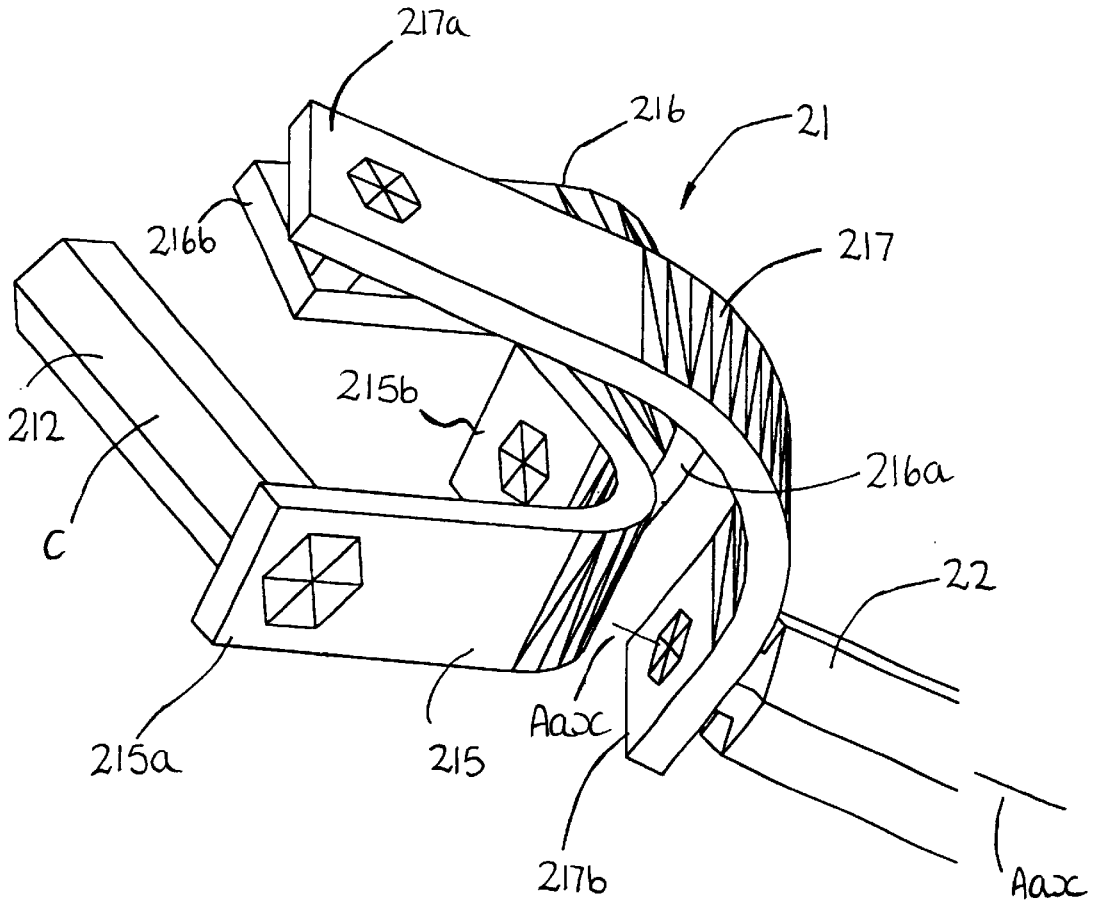

FIG. 6*d* is a plan view of the sixth exercise device shown in FIG. 6*a* with the arm portions in one position;

FIG. 6*e* is a plan view of the sixth exercise device shown in FIG. 6*a* with the arm portions in another position;

FIG. 7 is a perspective view of a seventh exercise device;

FIG. 8 is a perspective view of a modified form of the seventh exercise device;

FIG. 9 is a perspective view of an eighth exercise device;

FIG. 10 is a side view of a ninth exercise device;

FIG. 11 is a perspective view of a tenth exercise device;

FIG. 12 is a schematic view of a hydraulic system for use with the seventh to ninth exercise devices shown in FIGS. 7 to 10;

FIG. 13 is a schematic view of an alternative hydraulic system for use with the seventh to ninth exercise devices shown in FIGS. 7 to 10;

FIG. 14 is a schematic view of a hydraulic system for use with the tenth exercise device shown in FIG. 11;

FIGS. 15*a* to 15*d* are a rear perspective view, a front perspective view, a side and a plan view of an eleventh exercise device;

FIG. 16 is a perspective view of a handle for an exercise device; and

Figure 17:
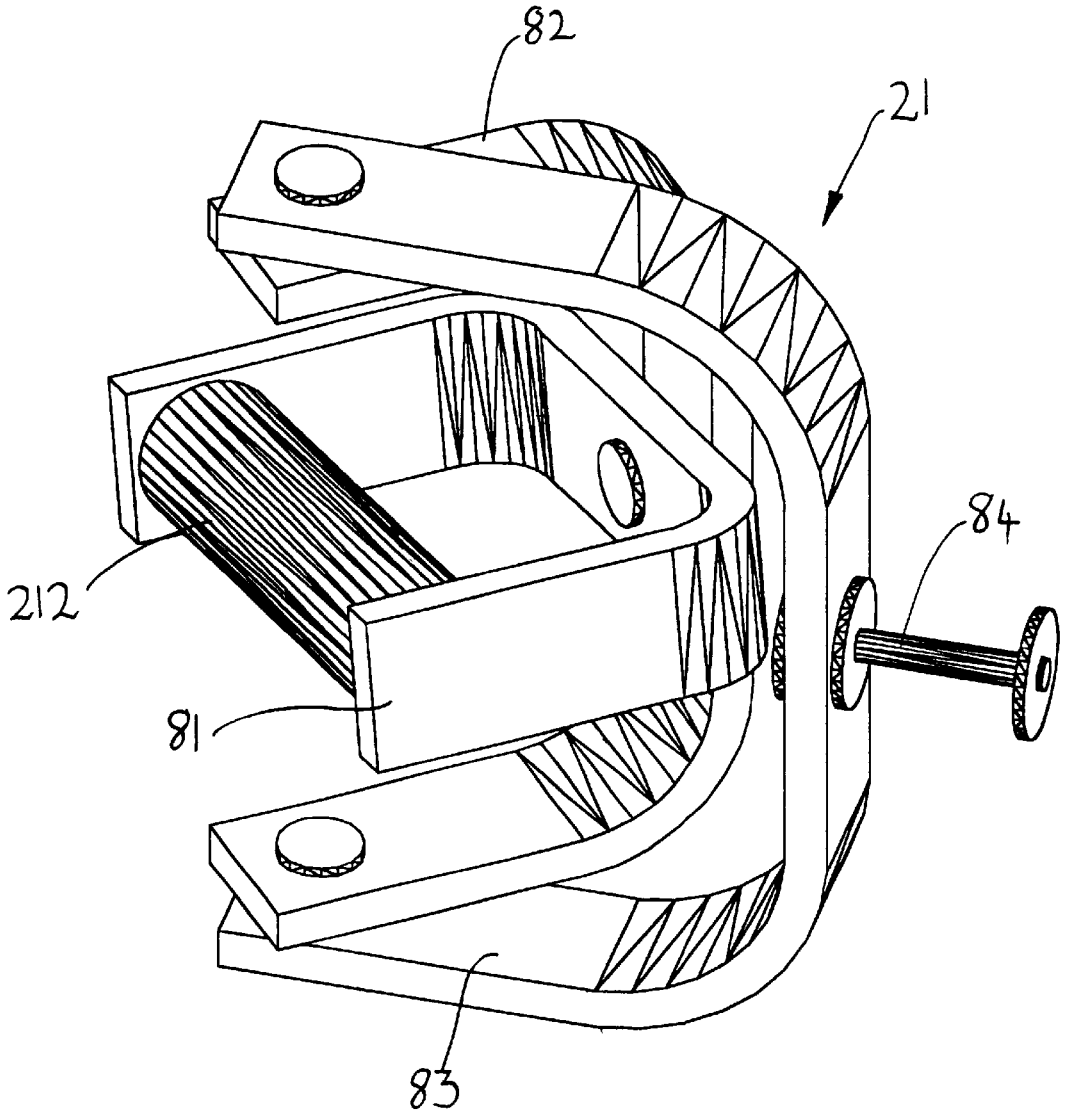

FIG. 17 is a perspective view of a handle for an exercise device.

Figure 18:
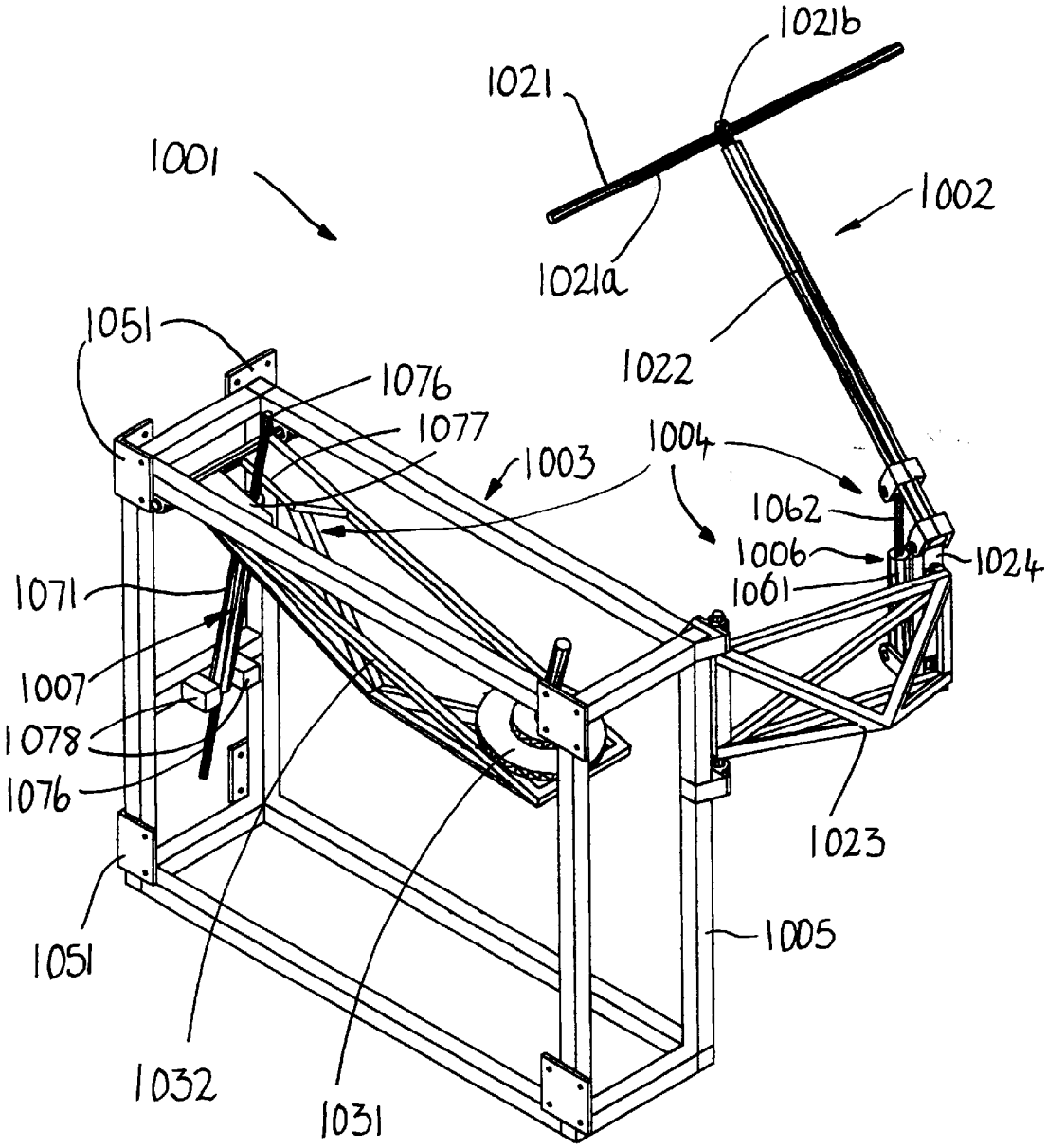
Figure 19:
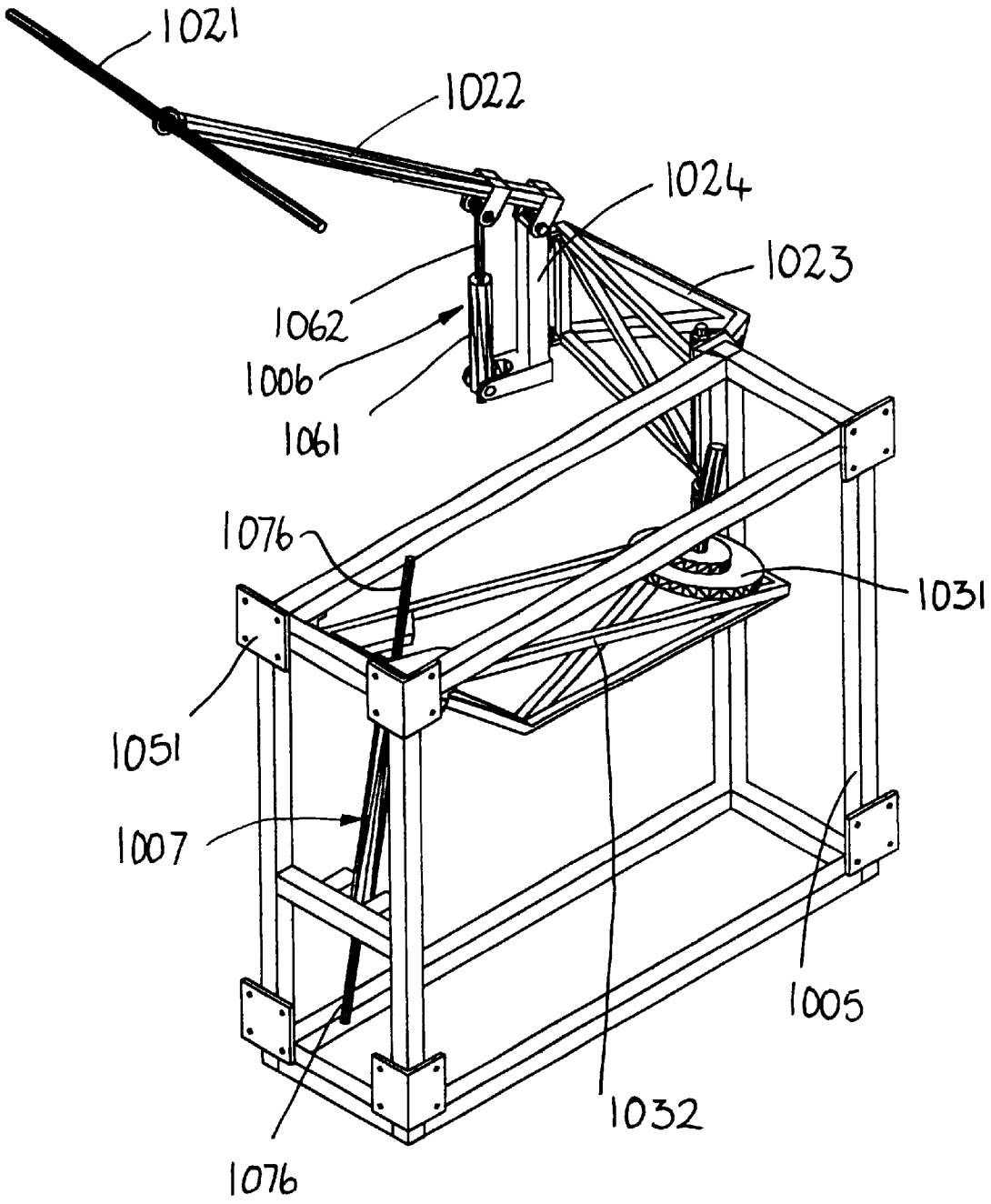
Figure 20:
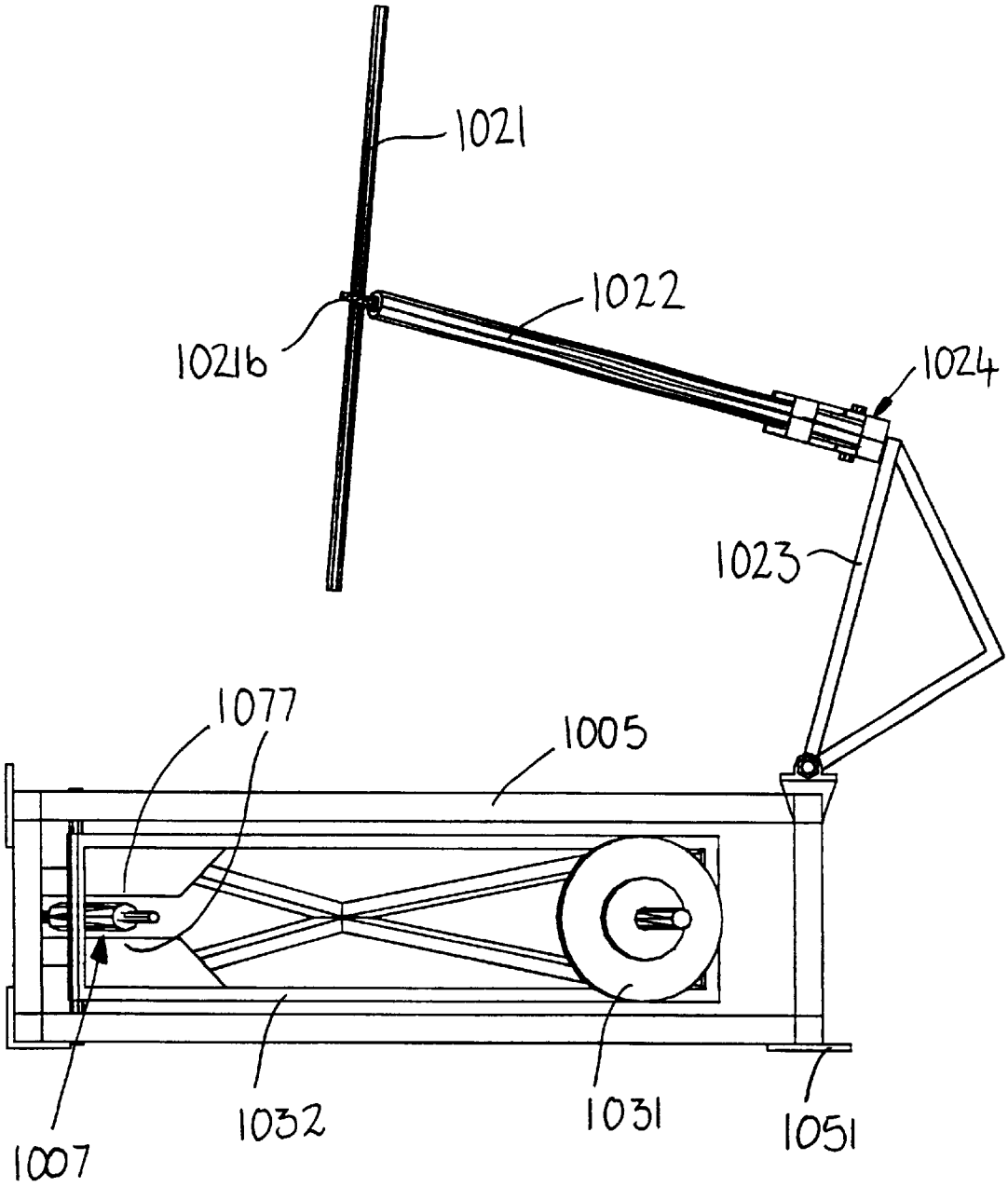
Figure 21C:
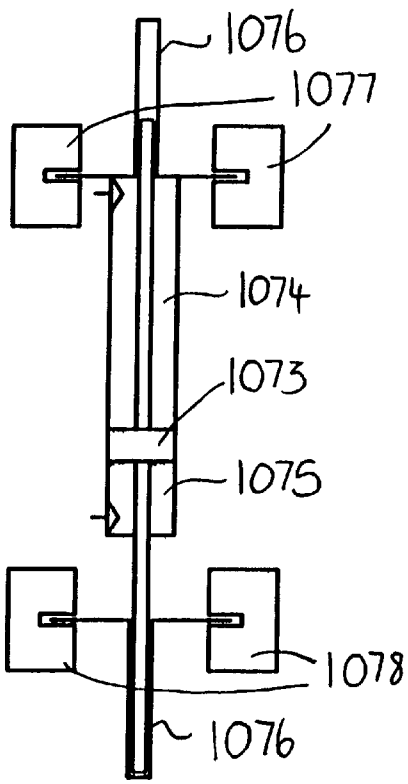
Figure 21B:
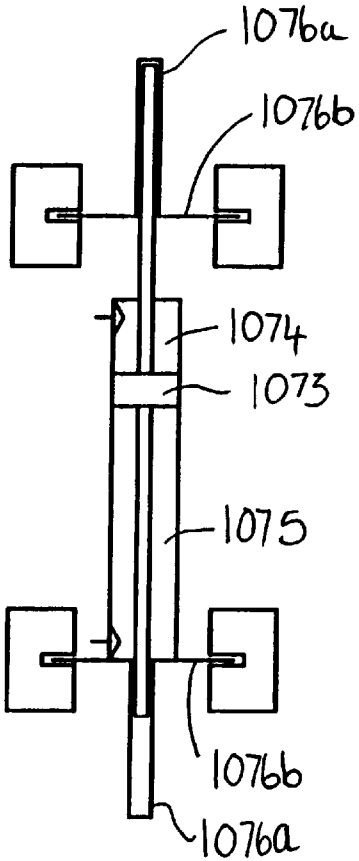
Figure 21A:
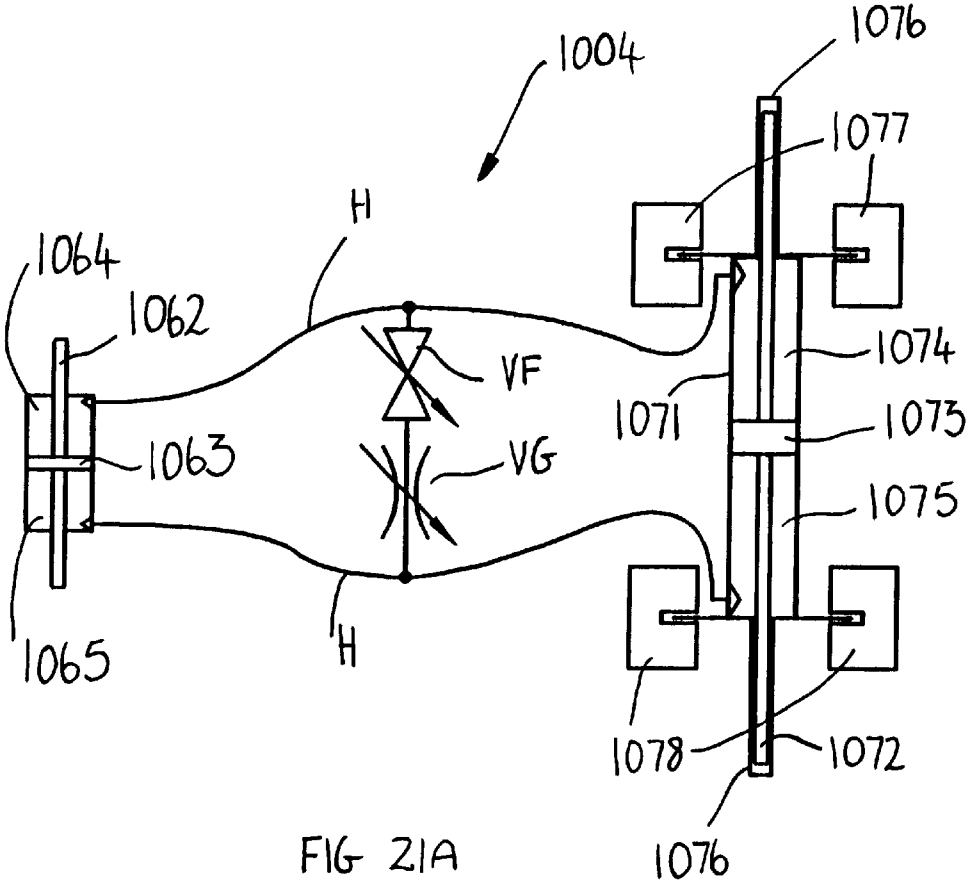

FIG. 18 is a perspective view of a twelfth exercise device;

FIG. 19 is a perspective view of the twelfth exercise device;

FIG. 20 is a plan view of the twelfth exercise device;

FIG. 21A, 21B, 21C are schematic view of a hydraulic arrangement of the twelfth exercise device.

Figure 1:
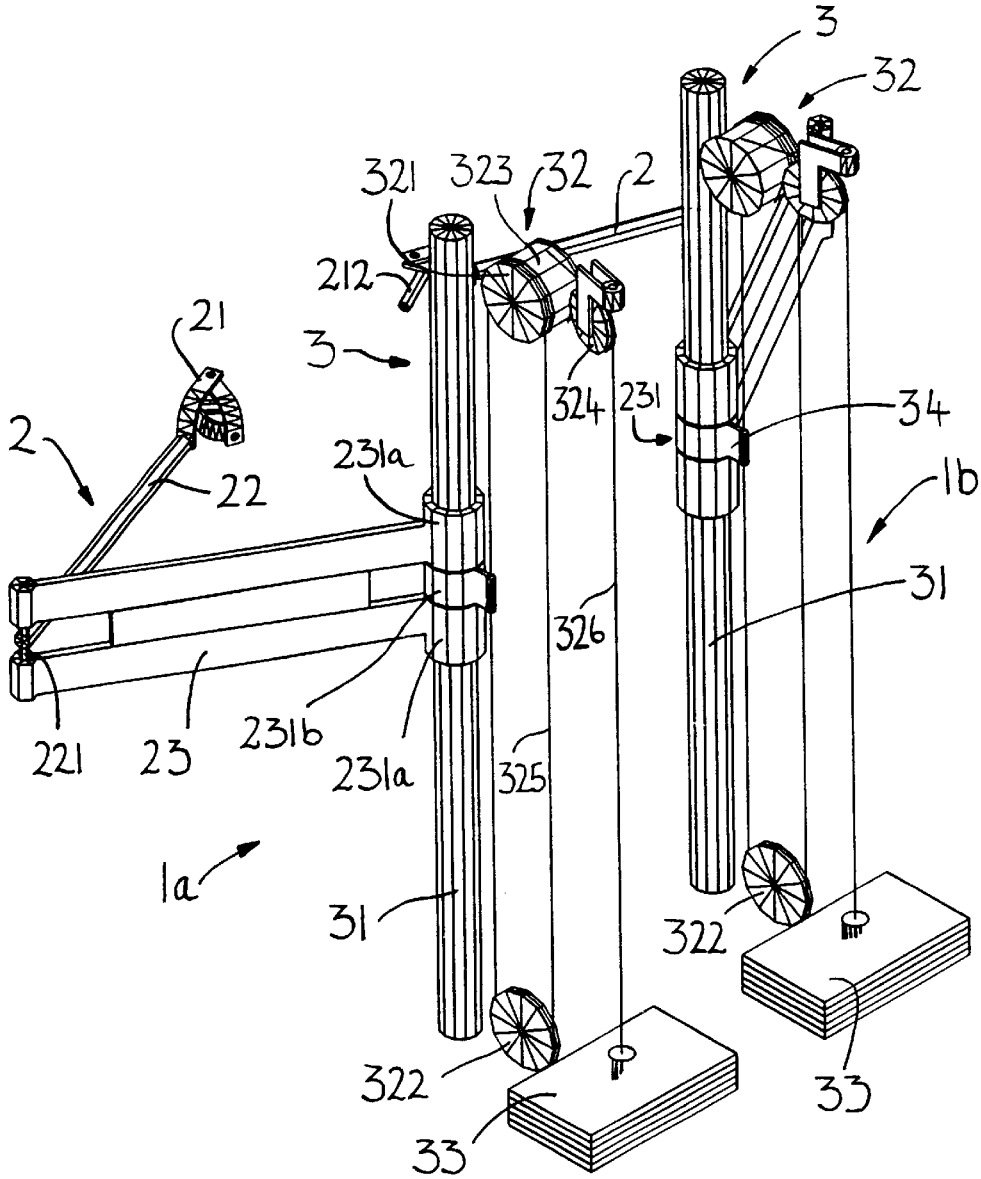
FIG. 1 is a perspective view of a first exercise device.

FIG. 1 shows a first exercise device which comprises two independent exercising units 1*a*, 1*b* which are similar to one another in construction.

Each exercising unit 1*a*, 1*b* comprises an articulated arm portion 2 and a loading portion 3.

Each arm portion 2 comprises a handle 21 which is pivotally connected to a first arm member 22, which in turn is pivotally connected to a second arm member 23.

Each loading portion 3 comprises a vertical guide pillar 31, a chain and pulley system 32, and a weight 33.

A weight guiding frame (not shown) of a conventional type is provided to guide the weight 33.

Each handle 21 comprises a grip portion 212 and is arranged so that the grip portion 212 can be rotated about two mutually perpendicular axes relative to the respective first arm member 22. Each first arm member 22 is joined to the respective second arm member via a hinge member 221 which allows pivotal movement of the first arm member 22 relative to the second arm member 23 about an axis. In normal operation this axis will be substantially vertical so that the arm members 22, 23 can move in a horizontal plane.

A sleeve 231 is provided at an end of each second arm member 23 remote from the respective first arm member 22. The vertical guide pillar 31 of each loading portion 3 is a sliding fit with the respective sleeve 231. A suitable bearing (not shown) is provided between the sleeve member 231 and the respective vertical guide pillar 31 to allow the sleeve 231 to move freely along the guide pillar 31 and to allow the respective arm portion 2 to pivot about the guide pillar 31. Each sleeve 231 comprises two outer portions 231*a* and a central portion 231*b*. The outer portions 231*a* are attached to the respective second arm member 23 and are rotated when the arm portion 2 is pivoted about the guide pillar 31 whereas the central portion 231*b* is not connected to the respective second arm member and does not rotate with the outer portions 231*a* when the arm portion 2 is pivoted about the guide pillar 31. However, because the central portion 231*b* is disposed between the outer portions 231*a* on the guide pillar 31, the whole sleeve 231 moves as one unit along the guide pillar 31 when the respective arm portion 2 is moved vertically.

Each chain and pulley system 32 comprises an upper loop chain wheel 321, a lower loop chain wheel 322, a driven pulley wheel 323 and an idle pulley wheel 324. The upper loop chain wheel 321 is spaced above the lower loop chain wheel 322 and a continuous loop chain 325 is provided to run around the upper and lower loop chain wheels, 321 and 322. A weight-hoisting pulley belt 326 is attached to the outer surface of the driven pulley wheel 323 (which acts as a drum). The weight-hoisting pulley belt 326 passes from the driven pulley wheel 323 over the idle pulley wheel 324 and is attached to the weight 33.

The upper loop chain wheel 321 and the driven pulley wheel 323 are arranged to be rotatable about a common axis and can be engaged and disengaged to one another against relative rotation by means of a clutch (not shown) which can be pedal operated. In normal operation the clutch is engaged and in the following description it should be assumed that the clutch is engaged unless it is otherwise stated.

The central portion 321*b* of each sleeve 321 is provided with a tab 34 which is connected to the loop chain 325 and is for transmitting motion of the sleeve 231 along the vertical guide column 31 to the continuous loop chain 325.

Each of the exercising units 1*a*, 1*b* comprise the same elements and operates in the same way. In use the two exercising units 1*a*, 1*b* are positioned in a side-by-side relation. A user of the exercise device stands in the space in front of the two exercising units 1*a*, 1*b* and can grasp the handle 21 of one unit 1*a* in one hand and the handle 21 of the other unit 1*b* in his other hand. Various exercise movements can be carried out due to the movement allowed by the configuration of the arm portions 2. Vertical movement of each arm portion 2 can resisted due to the arrangement of the exercising units 1*a*, 1*b*.

Movement of each arm portion 2 in the vertical direction relative to the loading portion 3 causes the respective sleeve 231 to slide along the respective vertical guide pillar 31. Each arm portion 2 can be moved both upwards and downwards relative to the respective loading portion 3.

Each arm portion 2 has a null height. At the null height the weight 33 is in its lowest possible position and correspondingly the weight-hoisting belt 326 is fully unwound from the driven pulley wheel 323. Movement away from this null height, either in an upward or a downward direction, causes the weight 33 to rise and thus resistance will be experienced by the user.

The null height can be adjusted by means of the clutch provided between the upper chain wheel 321 and the driven pulley wheel 323. When the clutch is disengaged the loop chain 325 can be moved independently of the driven pulley wheel 323 and in this way the null height can be adjusted. Once this has been done the clutch can be re-engaged.

As the arm portion 2 is moved in a downward direction from the null height, the motion is transmitted by the tab 34 to the continuous chain 325 so that a portion of the chain 325 also moves in a downward direction. This movement of the chain 325 causes the upper and lower loop chain wheels 321, 322 to rotate in an anti-clockwise direction (as seen in FIG. 1*a*). Consequently, the driven pulley wheel 323 is driven in the same direction and the weight-hoisting pulley belt 326 is wound around the driven pulley wheel 323 so raising the weight 33. Thus the downward movement of the respective arm portion 2 is resisted due to gravity acting on the weight 33.

As the arm portion 2 is moved in an upward direction from the null height, the motion is transmitted via the tab 34 to the continuous loop chain 325 so that a portion of the chain 325 also moves in an upward direction. This movement of the chain 325 causes the upper and lower loop chain wheels 321, 322 to rotate in a clockwise direction (as seen in FIG. 1*a*). Consequently, the driven pulley wheel 323 is driven in the same direction and the weight-hoisting pulley belt 326 is wound around the driven pulley-wheel 323 so raising the weight 33. Thus, upward movement of the arm portion 2 is also resisted by gravity acting on the weight 33.

Figure 2:
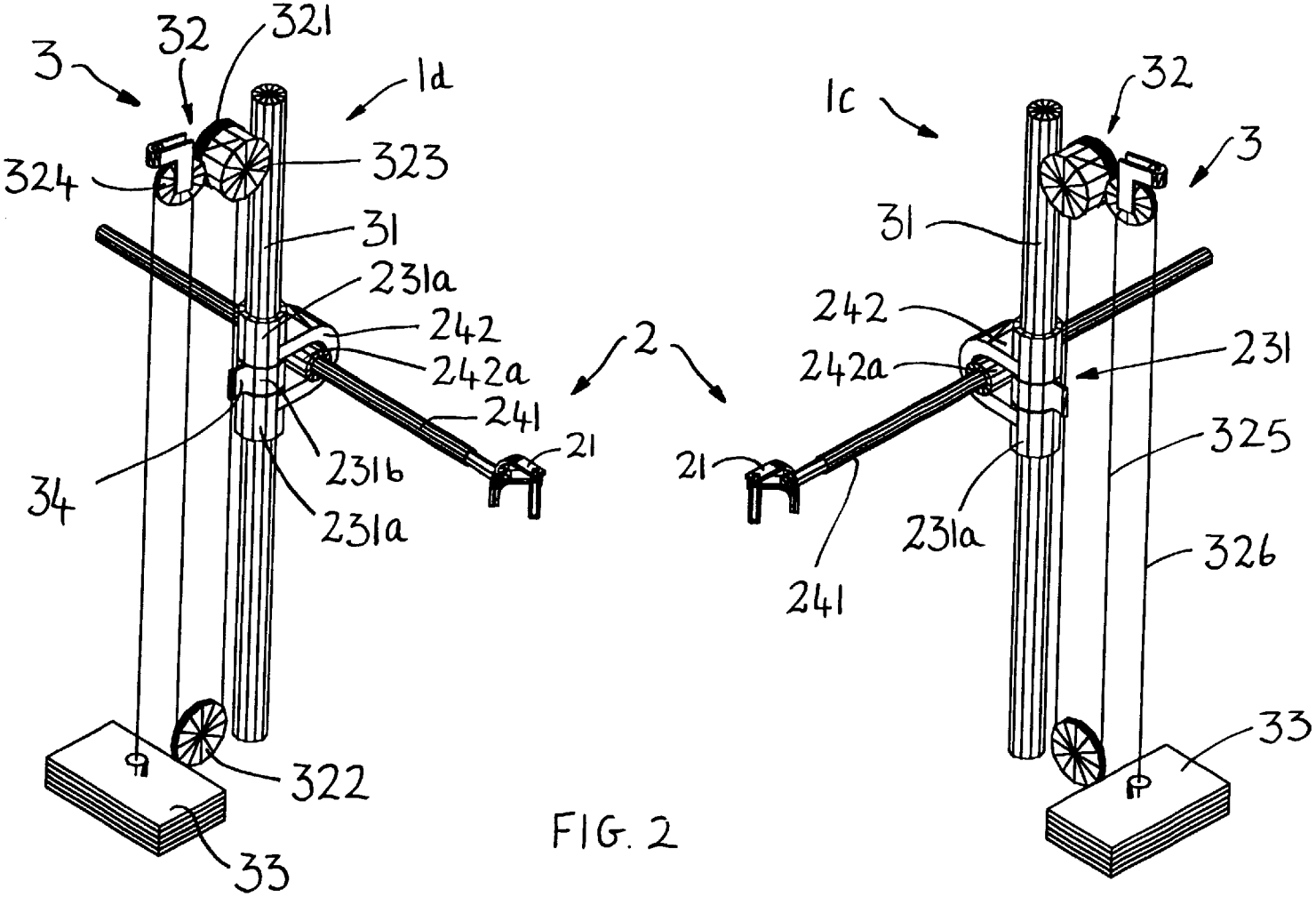
FIG. 2 is a perspective view of a second exercise device.

FIG. 2 shows a second exercise device which comprises two exercising units 1*c*, 1*d*, each of which comprises an arm portion 2 and a loading portion 3. Loading portions 3 of the exercising units 1*c* and 1*d* of the second exercise device are substantially the same as the loading portions 3 in the first exercise device.

In the second exercise device each of the arm portions 2 comprises one linear arm member 241 which is mounted for slidable movement in a sleeve 242*a* provided in a corresponding U-shaped member 242. A bearing (not shown) is provided in the sleeve 242*a* to permit the sliding movement of the arm member 241 relative to the U-shaped member 242. One end of each U-shaped member 242 is mounted on one of the outer portions 231*a* of the respective sleeve 231 mounted on a vertical guide pillar 31 and the other end is mounted on the other outer portion 231*a*. A handle 21 is mounted on one end of each of the linear arm members 241. The structure and function of each sleeve 231 mounted on the guide pillars 31 and the associated tab 34 is the same as in the first exercise device.

FIG. 2 shows the linear arm members 241 in central positions. It will be appreciated that the linear arm members 241 may be slid through the respective U-shaped member 242 from a position in which the respective handle 21 is substantially adjacent to the U-shaped member 242 to a fully extended position. Rotation of the arm portion 2 about the guide pillar 31 is allowed by the bearing (not shown) between the sleeve 231 and the guide pillar 31. Movement of the arm portions 2 in a vertical direction is facilitated by the same means as in the first exercise device and causes the same effects. Thus, resistance to movement in the upward and the downward directions can be provided by the exercise units 1*c*, 1*d* of the second exercise device.

Similarly to the first exercise device a user can grasp one handle 21 in each hand to perform exercises.

Figure 3:
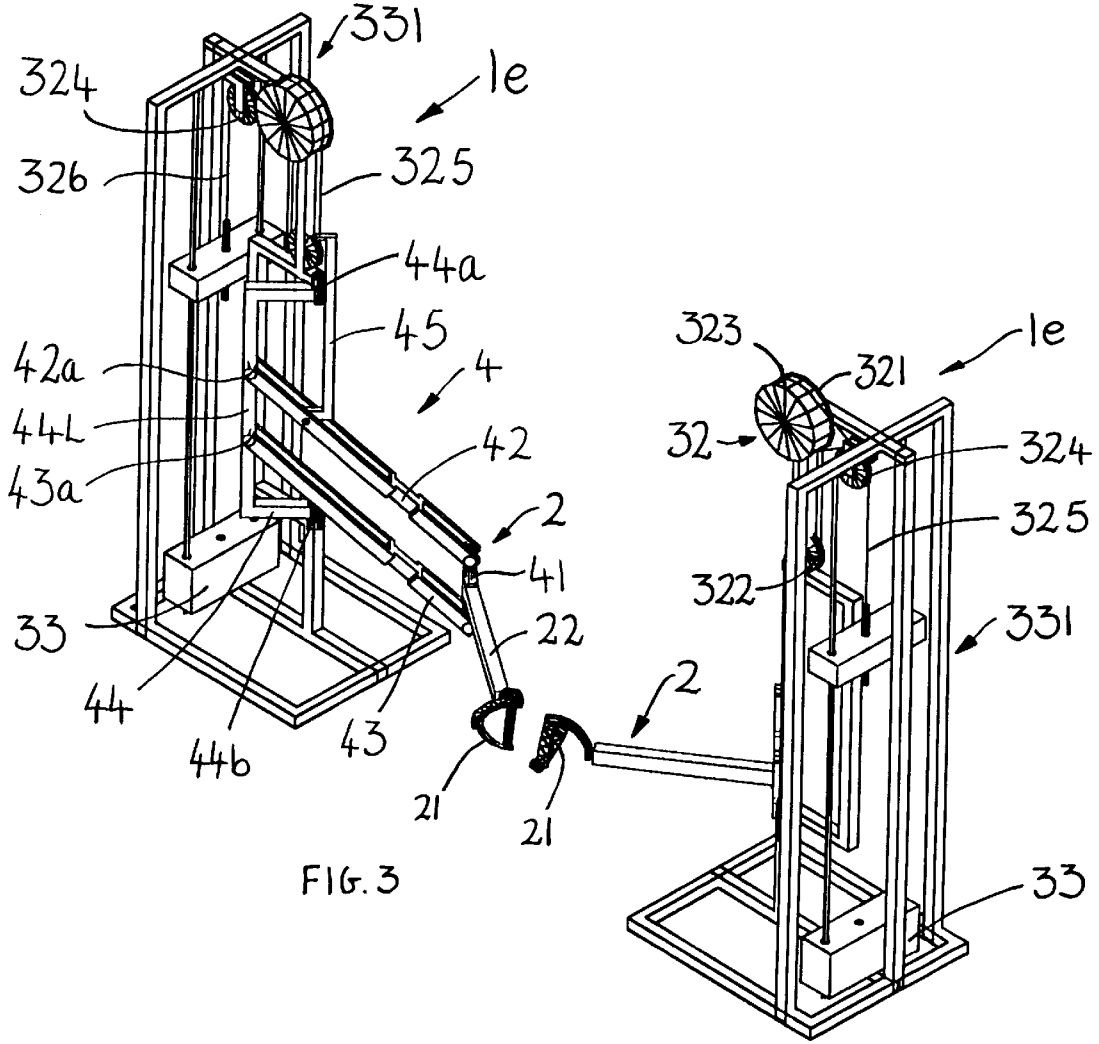
FIG. 3 is a perspective view of a third exercise device.

FIG. 3 shows a third exercise device comprising two exercising units 1*e* in each of which the chain and pulley system 32, the weight 33 and the weight guiding frame 331 have a similar construction to that described above. However the loading portion 3 does not include a vertical guide pillar 31 and the arm portion 2 has a modified construction.

The third exercise device provides different means for transmitting the vertical motion of the arm portion 2 to the continuous loop chain 325. A parallelogram assembly 4 and rod 45 are provided for transmitting the vertical motion of the arm portion 2 to the continuous loop chain 325.

The parallelogram assembly 4 comprises first, second and third linear members 41, 42, 43 and a linear portion 44L of a c-shaped member 44. The linear members 41–43 and the linear portion 44L are pivotally connected to one another at respective ends to form a parallelogram in a substantially vertical plane. A first arm member 22 is pivotally mounted to the first linear member 41 to allow pivotal movement of the first arm member 22 in a substantially horizontal plane, relative to the first linear member 41. A second arm member 23 comprises the second and the third linear members 42, 43.

The c-shaped member 44 is pivotally mounted at its ends 44*a*, 44*b* to the loading portion 3 so that the linear portion 44L is in a substantially vertical orientation. The first, second and third linear members 41, 42, 43 can therefore move together, in any one of a number of planes which are substantially vertical, about pivots 42*a* and 43*a* provided at ends of the second and third linear members 42, 43. The first linear member 41 remains substantially vertical whatever its position relative to the linear portion 44L.

The rod 45 is provided for transmitting the vertical motion of the second linear member 42 to the continuous loop chain 325. One end of the rod 45 is pivotally mounted to a suitable position on the second linear member 42 and the other end of the rod 45 is connected to a suitable position of the continuous loop chain 325.

In each exercising unit 1*e*, when the arm portion 2 is moved in an upward or a downward direction, the motion is transmitted via the parallelogram assembly 4 and the rod 45 to the loop chain 325. In turn, this causes the chain and pulley system 32 to operate in such a way that the weight 33 is raised when the arm portion 2 is moved in either an upward or a downward direction away from a null height.

The structure and operation of the chain and pulley system 32 in the third exercise device is essentially the same as that of the first exercise device. However, due to the decrease in movement transmitted by the transmitting means, because of the effect of the parallelogram assembly 4, the chain and pulley wheels 321–324 in the third exercise device can be provided with differing numbers of teeth and/or be of different diameters than those in the first exercise device. This can be done to ensure that an appropriate range of movement is provided for both the arm portion 2 and the weight 33. In particular, it may be desirable to provide a driven pulley wheel 323 of a larger diameter so that a given movement of the rod 45 causes a larger vertical movement of the weight 33 than in the first exercise device.

FIGS. 4*a* and 4*b* show a fourth exercise device comprising two exercising units 1*f*. This exercise device allows the same general arrangement of the first exercise device to be used to provide resistance against rotational movement of a first arm member 22 around a horizontal axis.

The chain and pulley system 32 in the fourth exercise device is similar to that in the third exercise device except that a weight pulley 33*a* is provided around which runs a weight-hoisting pulley belt 326. One end of the weight-hoisting pulley belt 326 is attached to a driven pulley 323 associated with a first arm portion 2*a* and the other end is connected to a driven pulley 323 associated with a second arm portion 2*b*. The weight pulley 33*a* is attached to the weight 33 and because of the arrangement of the weight-hoisting pulley belt 326, movement of either the first or the second arm portions 2*a* or 2*b* away from their respective null positions will cause the weight 33 to rise. In each case, movement of the arm portion 2*a*, 2*b* away from its null position causes one end the pulley belt 326 to be wound around the respective driven pulley wheel 323, so shortening the free length of pulley belt 326.

Each arm portion 2*a*, 2*b* comprises a first arm member 22 which is pivotally mounted to a first c-shape member 251 to allow movement of the first arm member 22 around a horizontal axis. The first c-shaped member 251 in turn is pivotally mounted to a first end of a second arm member 23 and a second c-shaped member 252 is pivotally mounted to a second end of the second arm member 23. The second c-shaped member 252 is formed integrally with the loading portion 3 and a following arm 46 is pivotally connected to the second c-shaped member 252. A distal end of the following arm 46 is connected to one end of a rod 45, the other end of which is connected to the continuous loop chain 325.

Each arm portion 2*a*, 2*b* is provided with a cable wheel and cable arrangement 5 (see FIG. 4*b*) so that rotational movement of the first arm member 22 can be transmitted to the following arm 46. A loop cable 51 is provided to run around a drive cable wheel 52, a driven cable wheel 53 and a series of intermediate idle cable wheels 54.

In the fourth exercise device the arm portions 2*a*, 2*b* cannot move linearly in the vertical direction but each first arm member 22 can rotate about the horizontal axis at the point where it is pivotally mounted to the first c-shape member 251. When such rotational movement is executed, the drive cable wheel 52 drives the cable 51 in such a way that the driven cable wheel 53 causes the following arm 46 to execute the same motion as that of the first arm portion 22. In consequence of this the rod 45 transmits motion to the loop chain 325 so causing the weight to be raised or lowered.

The arrangement of the following arm 46 and the rod 45 is such that only the vertical component of the following arm's 46 motion is transmitted to the loop chain 325.

In performing exercises with the fourth exercise device, the positions of the arms 2*a*, 2*b* can be altered by pivoting the second arm member 23 in a horizontal plane relative to the first and second c-shaped members 251, 252.

FIG. 5 shows an exercising unit 1*g* of a fifth exercise device which is similar to that of the second exercise device except that the vertical guide pillar 31 is replaced by a vertical guide rail 31*a* and the sleeve 231 and U-shaped member 241 are replaced by a roller assembly 6. In this exercise device horizontal and vertical movement of the arm portion 2 is facilitated by the roller assembly 6. The roller assembly 6 comprises a square plate 61 upon which 8 rollers 62 are mounted. Four of the rollers 62*a* are associated with the vertical guide rail 31*a* and four of the rollers 62*b* are associated with the arm portion 2. A pair of rollers 62*a* or 62*b* is provided at each side of the square plate 61. In each pair of rollers one roller 62*a* or 62*b* is provided on one side of the vertical guide rail 31*a* or the arm portion 2 respectively and the other roller 62*a* or 62*b* is provided on the other side of the vertical guide rail 31*a* or the arm portion 2 as appropriate. The structure and arrangement of the rollers 62*a*,62*b* is such that movement in both the horizontal and vertical directions is allowed.

Locking means may be provided to lock the arm in any chosen vertical or horizontal position.

Rotational movement of the guide rail 31*a* about a vertical axis is facilitated by mounting transverse members 63 of the guide rail 31 via bearings 631 to suitable structure. The vertical axis is directly aligned with the portion of the loop chain 325 to which the tab 34 is attached.

In an alternative the tab or rod 34 or 45 can be connected to the loop chain 325 by a removable pin allowing the point of connection between the tab or rod 34 or 45 and the loop chain 325 to be adjusted. This provides a further or alternative means for adjustment of the null height.

The weight hoisting pulley belt can be formed of two parts one end of each being attached to the weight and the other ends being attached to diametrically opposed positions on the surface of the driven pulley wheel. The points of attachment can be chosen such that when the weight is at its lowest possible height both the parts of the pulley belt are fully unwound and the point of attachment of one of the parts is at the top of the driven pulley wheel and the point of attachment of the other part is at the bottom of the driven pulley wheel. In this way when the driven pulley wheel is rotated in each direction a respective one of the parts is immediately taut while the other part is slack. The weight is then hoisted by the part of the belt which is taut and the other part is just wound on as slack. This arrangement minimizes the amount of free vertical movement of the arm portions before the resistance due to the weight takes effect.

The weight hoisting pulley belt can be replaced by a cable, a rope or a chain. The loop chain can be replaced by a loop pulley belt, cable, or rope.

FIGS. 6*a* to 6*e* show a sixth exercise device. The sixth exercise device comprises two exercising units 1*h* which comprise an articulated arm portion 2 and a common loading portion 3. Each arm portion 2 comprises a handle 21 which is pivotally connected to a first arm member 22 which in turn is pivotally connected to a second arm 23. Each second arm 23 is pivotally connected to a frame 7.

Each of the first arm members 22 is mounted for sliding vertical movement along a respective vertical guide rail 31*a*. Each first arm member 22 is provided with four wheels 71 which contact with the vertical guide rail and which are arranged to allow smooth relative movement between the first arm members 22 and the vertical guide rails 31*a*.

An end 22*a* of each first arm member 22 is attached to a common continuous wire loop 72. The attachment between the first arm member 22 and the wire loop 72 is such that the first arm member 22 can pivot freely around the wire loop 72 at the attachment point but movement of the first arm member 22 in either vertical direction causes the wire loop 72 to move in that direction.

In FIGS. 6*b* and 6*c* the common wire loop 72 is shown with single arrow heads along its length to aid in following the path of this loop. These arrow heads show how the wire loop 72 could move around its path in one direction but it will be understood that the actual movement of the wire loop 72 in use is not restricted to movement in such a direction.

The path of the common wire loop 72 is defined and restricted by sixteen fixed pulley wheels 72*a* to 72*p* and a pair of floating pulley wheels 73*a* and 73*b* mounted in a floating block 73. The eight fixed pulley wheels 72*a* to 72*h* on one side of the floating block 73 are associated with one arm portion 2 and the other eight fixed pulley wheels 72*i* to 72*p* on the other side of the floating block 73 are associated with the other arm portion 2.

One end of a strap loop 74 is attached to one end of the floating block 73 and another end of the strap loop 74 is connected to another end of the floating block 73. The path of the loop strap 74 is defined and restricted by four fixed pulley wheels 74*a* to 74*d* and a pair of moveable pulley wheels 75*a* and 75*b* mounted in a moveable block 75. In FIGS. 6*b* and 6*c* the path of the strap loop 74 is indicated with double arrow heads to aid in understanding. It will be appreciated that whilst these arrow heads represent one direction in which the strap loop 74 may move, movement is not restricted to this direction when the apparatus is in use.

A weight 33 of the common loading portion 3 is supported by a weight hoisting pulley strap 326 which has first and second ends 326*a* and 326*b* remote from the weight 33. Each of these ends 326*a* and 326*b* is connected to the loop strap 74; the connecting positions of each end 326*a*, 326*b* being different from one another. The weight 33 is a conventional weight stack which is arranged so that the weight to be hoisted can be varied.

The weight hoisting pulley strap 326 passes over a fixed pulley wheel 76 so that the weight 33 is moved upwards when either of the ends 326*a* and 326*b* is moved away from the fixed pulley wheel 74*b*.

It will be appreciated that where a fixed pulley wheel is referred to in this application, this refers to the fact that although the pulley is journalled for rotation, it is not able to move in a lateral direction for example, relative to the frame 7. This is in contrast to the moveable and floating pulley wheels 73*a*, 73*b*, 75*a* and 75*b*.

The frame 7 comprises a rack 77 for supporting the moveable block 75. The rack 77 comprises two parallel vertical members 77*a* and 77*b* each of which has a plurality of apertures 78. The plurality of apertures 78 are arranged so that the moveable block 75 can be supported in any one of a plurality of different positions between the vertical members 77*a* and 77*b* by passing suitable pin 79 through the desired apertures 78 into the moveable block 75.

In use an exerciser can grasp one of the handles 21 in each hand and position the first arm members 22 in the desired horizontal positions making use of the pivotal connections between the first and second arm members 22, 23 and between the second arm members 23 and the frame 7. FIGS. 6*d* and 6*e* show two of the different positions in which the handles 21 can be located by the user and it will be appreciated that the range of movement in the horizontal plane of each of the handles 21 is very substantial.

It should be noted that the section of the continuous wire loop 72 between fixed pulleys 72*b* and 72*c*; 72*f* and 72*g*; 72*j* and 72*k*; and 72*n* and 72*o* are aligned with the pivot axis between the respective second arm member 23 and the frame 7. This allows pivotal movement of the second arm members 23 around this axis.

Similarly the portions of the continuous wire loop 72 between fixed pulley wheels 72*d* and 72*e* and between the fixed pulley wheels 72*l* and 72*m* are aligned with the pivot axis between the respective first and second arm members 22, 23 to allow each first arm member 22 to pivot freely around the respective pivot axis.

Similarly to the exercise devices described above, each of the first arm members 22 has a null height, movement away from which in either direction is resisted by the weight 33.

When the first arm members 22 are both at their null eights the weight 33 is in its lowermost position and movement of either of the first arm members 22 in either direction away from these null heights will cause the weight 33 to rise.

However, if the first arm members 22 are moved in opposite directions away from their null heights by the same amount, then the net effect will be to leave the weight at its lowermost position so that no resistance is provided to such a motion.

The mechanism causing the weight to rise when either of the first arm members 22 are moved away from their null heights will now be described with particular reference to FIGS. 6*b* and 6*c*.

Considering the situation where each of the first arm members is at its null height so that the weight 33 is in its lowermost position, the operation of the pulley arrangement will be described as an exerciser pushes downwards on the first arm members.

It will be recalled that the first arm members are fixed to the wire loop 72 such that as the first arm members are moved the wire loop 72 is caused to move with them. Thus, as the first arm members are pushed downwards the wire loop 72 is pulled downwards over the fixed pulleys 72*e* and 721. This in turn causes the sections of the wire loop 72 between the fixed pulley wheels 72*h* and 72*i* and the floating pulley wheel 73*a* to shorten, whilst the sections of the wire loop 72 between the fixed pulley wheels 72*a* and 72*p* and the floating pulley wheel 73*b* are lengthened. The net result of this is that the floating block 73 rises upwards. This causes the loop strap 74 to pass over the fixed pulley wheel 74*a* around the moveable pulley wheel 75*a*, over the fixed pulley wheel 74*b* and downwards. This movement of the loop strap 74 is reflected by the lower half which moves in corresponding directions.

It will be recalled that the moveable block 75 and associated pulley wheels 75*a*, 75*b* are fixed in position by the rack 77.

The net result is that the second end 326*b* of the weight hoisting pulley belt 326 is pulled downwards with the loop strap 74 so pulling the weight hoisting pulley belt 326 over the fixed pulley 76 to raise the weight 33.

During this operation a section of the weight hoisting pulley belt 326 associated with the first end 326*a* goes initially slack because connection point between the first end 326*a* and the loop strap 74 is initially moving towards the weight 33. Since moving the first arm members 22 downwards causes the weight 33 to rise, this movement of the first arm members 22 is resisted.

When the first arm members 22 are moved upwards, from the null height, a similar but opposite operation occurs. In this case the first end 326*a* of the weight hoisting pulley belt 326 will be taut, initially, whereas the second end 326*b* will be slack. The provision of the two separate ends 326*a* and 326*b* having distinct connection points helps to eliminate free vertical movement of the first arm members 22 before resistance due to the weight 33 is incurred.

In the sixth exercise device the null height can be adjusted by moving the moveable block 75 between the various positions made possible by the arrangement of the rack 77. Moving the movable block 75 to a lower position will decrease the null height of each of the first arm members 22. This can be most easily understood by referring to FIGS. 6*b* and 6*c*. Considering the situation when the weight 33 is in its lowermost position so that the first arm members 22 are at their null heights, moving the movable block 75 downwards without moving the weight 33, has the effect of pulling the floating block 73 upwards towards the fixed pulley 74*a*. This in turn has the effect of allowing more of the wire loop 72 to pass upwards past the fixed pulleys 72*h* and 72*i* and correspondingly causes more of the wire loop 72 to move downwards past fixed pulleys 72*e* and 72*l* so that the first arm members 22 move downwards. Once this has been done and the moveable pulley block 75 has been locked into the desired position using the pins 79, the weight 33 is still at its lower most position so that the first arm members 22 are at their null height but the height of the first arm members 22 relative to the frame 7 has been lowered.

In each of the above exercise devices it will be appreciated that the mass of the weight 33 can be altered in a conventional way. Typically a stack of weights will be provided, differing numbers of which may be attached to the weight hoisting pulley 326.

In alternatives a hydraulic system can be used in place of some or all of the pulley and belt systems described for transmitting the movement of the arm portion to the load. For example, it is possible to use a cylinder which is actuated by movement of the arm portion as a master cylinder to supply oil to a slave cylinder, the movement of which is resisted by an appropriate load. Alternatively movement of the arm portion can be used to actuate a rotary pump to drive oil for example, to a slave master cylinder, the passage of oil being inhibited by some load which the exerciser can work against.

FIG. 7 shows a seventh exercise device. The seventh exercise device comprises two exercising units 1*j* which comprise an articulated arm portion 2 and a common loading portion 3. Each arm portion 2 comprises a handle 21 which is pivotally connected to a first arm member 22 which in turn is pivotally connected to a second arm member 23 via a third arm member 91. Each second arm member 23 in turn is pivotally connected to a frame 7. The pivotal connections between the frame 7 and each second arm member 23 and between the respective second and third arm members 23, 91 allow movement of the first, second and third arm members 22, 23 and 91 in a horizontal plane. Each first arm member 22 is pivotally connected to the respective third arm member 91 in such a way to allow movement of the first arm member 22 and the handle 21 in a vertical place about the pivotal connection point.

Each articulated arm portion comprises a hydraulic arm cylinder 92 comprising a rod 92*a* one end of which is pivotally connected to the respective first arm member 22 and a casing 92*b* one end of which is pivotally connected to the respective third arm member 91.

The loading portion 3 comprises a weight 33 which is mounted on a weight bearing member 93 and two hydraulic weight cylinders 94 each comprising a casing 94*a* and a rod 94*b*. The weight bearing member 93 is pivotally connected to the frame 7 at a first connection point 95 and the casings 94*a* of the hydraulic cylinders 94 are pivotally connected to a second connection point 96 of the frame 7. The rods 94*b* of the hydraulic cylinders 94 are pivotally mounted to the weight bearing member 93.

In operation upward or downward movement of the first arm members 22 about their respective pivot points causes hydraulic fluid to be driven from the arm cylinders 92 to the weight cylinders 94, so raising or lowering the weight 33 as appropriate. Thus the hydraulic cylinders and associated hydraulic hosing (not shown in FIG. 7) acts as the transmitting means for transmitting the movement of an exerciser to the load. Correspondingly the load provides resistance, via the hydraulic arrangement, to movement by the exerciser. More details of the hydraulic arrangements are given later in the description.

FIG. 8 shows a modified form of the seventh exercise device. The structure and operation of this modified version is the same as that of the seventh exercise device except that a bar 97 is provided joining the handles 21 to one another. This obviously serves to restrict the relative movement which can occur between the two articulated arm portions 2 but is a configuration which may be useful for performing some exercises.

FIG. 9 shows an eighth exercise device comprising two exercising units 1K. The structure and function of this device is similar to that of the seventh exercise device. The same reference numerals are used to show the common elements and a detailed description of the common elements is omitted. The eighth exercise device is different from the seventh exercise device in that an additional frame 98 is provided so that one of the articulated arm portions 2 is pivotally connected to the main frame 7 and the other articulated arm portion 2 is pivotally connected to the additional frame 98. The loading portion 3 and the hydraulic cylinders 92 and 94 are the same as those in the seventh exercise device and appropriate hydraulic hosing is provided to connect the arm cylinders 92 and the weight cylinders 94. The advantage of the eighth exercise device is that the additional frame 98 can be moved relative to the frame 7 to any position suitable for performing exercises. The range of movement of the additional frame 98 is restricted by the hoses connecting the arm and weight cylinders 92 and 94.

In the seventh and eighth exercise devices, the weight 33 mounted on the end of the weight bearing member 93 can be adjusted by addition or removal of weight plates in the same way as a conventional weight lifting bar.

FIG. 10 shows a ninth exercise device which is similar to the seventh exercise device but which has a modified loading portion 3 which comprises a pantograph type load bearing arrangement 99 comprising the weight bearing member 93 and a stack type weight 33. The pantograph arrangement 99 serves to keep a central bar 33*b* of the weight substantially vertical. The weight to be lifted can be modified by attaching differing numbers of weight plates 33*c* to the central bar 33*b* using a pin which passes through appropriate apertures in the weight plate 33*c* and the central bar 33*b*.

FIG. 11 shows a tenth exercise device which is similar to the seventh exercise device except that no handles 21 are provided and the loading portion is modified. The first arm members 22 are connected via universal ball joints to opposite ends of a bar 97. The weight-based loading portion 3 is replaced by the arm cylinders 92 and an associated hydraulic system including a variable restricter valve (not shown in FIG. 11) which provides resistance to motion of the bar 97. In this arrangement the resistance to motion of the exercise device caused by an exerciser is due purely to hydraulic means and no weights are required. A suitable hydraulic system for use in the tenth exercise device is described in more detail later in the description.

FIG. 12 shows a hydraulic system suitable for use with any one of the seventh, eighth or ninth exercise devices shown in FIGS. 7 to 10. Each arm cylinder comprises upper and lower chambers 92U and 92L and a piston 92P. Similarly, each of the weight cylinders 94 comprises upper and lower chamber 94U, 94L and a piston 94P. The upper and lower chambers 92U, 92L of the arm cylinders 92 are connected by hydraulic hose H through a number of valves VA1, VA2, VB1, VB2 to the upper and lower cylinders 94U and 94L of the weight cylinders 94 (only one of which is shown in FIG. 12 for simplicity).

As noted above FIG. 12 shows only one weight cylinder 94 and this is a possible configuration provided that the capacity of the cylinders 92, 94 are suitably chosen. When two weight cylinders 94 are used the upper chambers 94U of the weight cylinders 94 are connected to one another and the lower chambers 94L are also connected to one another to equalise the pressure therebetween.

It will be appreciated that when one of the first arm members 22 is moved in an upwards or downwards direction the respective piston 92P of the respective arm cylinder 92 will be made to move in a corresponding direction. This in turn will drive oil out of one of the upper and lower chambers 92U, 92L and into the other provided that there is a suitable fluid path available.

The arrangement of the hydraulic hosing H and valves VA1, VA2, VB1 and VB2 is such that when all of the valves are open there is a free fluid path between the upper and lower arm chambers 92U, 92L. This means that the pistons 92P can be moved upwards or downwards with practically no resistance. Thus with all of the valves VA1, VA2, VB1 and VB2 open the null height of the exercise units can be adjusted.

On the other hand when one of the pairs of valves (ie either VA1 and VA2 or VB1 and VB2) is closed and the other pair is open, movement of the pistons 92P due to the movement of either or both of the first arm members 22 will cause hydraulic fluid to be urged into either the upper or lower chambers 94U, 94L of the weight cylinder 94.

In the position shown in FIG. 12 the weight cylinder piston 94P is fully retracted so that introduction of hydraulic fluid into the lower chambers 94U will cause the piston 94P to rise. This motion, however, will be resisted by the weight 33 because as can be seen by referring back to FIGS. 7 to 10, the rod 94*b* is mounted to the weight bearing member 93 in such a way that upwards movement of the piston 94P causes the weight to rise. Further, in the position shown in FIG. 12, because the piston 94P is fully retracted, introduction of fluid into the upper chamber 94U is not possible. It can be said that motion of the first arm members 22 which tends to introduce fluid into the upper chamber 94U is therefore hydraulically locked.

If the first pair of valves VA1 and VA2 are open and the second pair of valves VB1 and VB2 are closed then downward motion of one or both of the first arm members 22 will cause hydraulic fluid to be forced out of the lower arm chambers 92L through the hosing H, through the open valve VA2 into the lower weight chamber 94U. Similarly hydraulic fluid will be drawn into the upper arm chambers 92U through the hosing H and the open valve VA1 from the upper weight chamber 94U. That is to say with the first pair of valves VA1 and VA2 open and the second pair of valves VB1 and VB2 closed, downward movement of one or both of the first arm members 22 will cause the weight cylinder 94 to extend and raise the weight 33. Therefore, downward movement of the first arm members 22 is possible but is resisted by the weight 33.

In contrast to this if one or both of the first arm members 22 is moved upwards hydraulic fluid will tend to be forced from the upper arm chambers 92U into the upper weight chamber 94U. However, because the piston 94P is fully retracted at this stage, motion in an upward direction away from the null height of the first arm members 22 is locked hydraulically.

In order for it to be possible to move the first arm members 22 upwards against the resistance of the weight 33 it is necessary to close the first pair of valves VA1 and VA2 and to open the second pair of valves VB1 and VB2. Then the paths of the hydraulic fluid are altered so that upward movement away from the null height is possible against resistance of the weight 33 but downward movement from the null height is hydraulically locked. Although this system is workable it has the disadvantage that the valves VA1, VA2, VB1, VB2 must be opened and closed to allow exercising in the different directions away from the null height.

FIG. 13 shows an alternative hydraulic arrangement for use with the seventh, eighth and ninth exercise devices shown in FIGS. 7 to 10. This arrangement has the advantage that movement in both directions away from the null height is possible without having to open or close any valves. In this arrangement two double end rod cylinders 910 are used, the bodies of which are fixed together. These cylinders 910 replace the weight cylinders 94 shown in FIGS. 7 to 10. One end of the piston rod 910P of one of the cylinders 910 is mounted to the weight bearing member 93. One end of the piston rod 910P of the other cylinder is mounted to the frame 7 at the second connection point 96. Thus the double end rod cylinders 910 are mounted to the frame 7 and the weight bearing member 93 in a similar position and in a similar way to the weight cylinders 94 as shown in FIGS. 7 to 10. This means that when the pistons move in an appropriate way the weight 33 will be raised or lowered.

Each of the cylinders 910 has an upper chamber 910U and a lower chamber 910L. The upper chambers 910U are connected to one another by a hydraulic hosing H and the lower chamber 910L are also connected to one another via hydraulic hosing H. The upper and lower chambers 910U and 910L of the double end rod cylinders 910 are connected via hydraulic hosing H and a valve VC to the upper and lower cylinders 92U and 92L of the arm cylinders 92.

With this arrangement when the valve VC is opened there is a substantially free fluid path between the upper and lower chambers 92U, 92L so that the pistons 92P can be moved freely upwards or downwards so that the null height of the associated first arm members 22 can be adjusted. However, when the valve VC is closed, movement of the first arm members 22 either alone or together in an upwards or downwards direction tends to force oil into either the upper or lower chambers 910U, 910L of the double end rod cylinders 910.

If the first arm members 22 are moved downwards hydraulic fluid is forced out of the lower chambers 92L of the arm cylinders and into the lower chambers 910L of the double end rod cylinders. In the view shown in FIG. 13 the left hand of the two double end rod cylinders 910 is fully contracted and the right hand is fully extended. This means that the hydraulic fluid cannot be further supplied to the right hand lower chamber 910L but can be further supplied to the left hand lower chamber 910L. Thus the net effect of moving the arm downwards is to force the left hand piston 910P upwards, therefore, raising the weight 33. Downwards movement of the first arm members 22 is therefore resisted.

On the other hand if the first arm members 22 are moved upwards, hydraulic fluid is fed to the upper chambers 910U of the two double end rod cylinders 910. In this case the situation is reversed and only the right hand double end rod cylinder 910 can receive hydraulic fluid. The net effect therefore is that the right hand piston 910P is extended. However, the end of the piston rod is mounted to the frame 7 so that the bodies of both of the double end rod cylinders 910 move upwards so that the weight 33 is raised.

Therefore, without having to open or close any valves, movement away from the null height in both directions can be resisted by the weight 33.

FIG. 14 shows a hydraulic arrangement for use with the tenth exercise device shown in FIG. 11. As stated above in this exercise device no weights are provided but rather the resistance to motion of the exerciser is provided purely by the hydraulic system. In this system the upper and lower chambers 92U, 92L of the two arm cylinders 92 are connected by hydraulic hosing H. The two upper chambers 92U are directly connected by hosing H and the two lower chambers 92L are directly connected to one another by hosing H. However, to allow movement of the bar 97 and first arm members 22 in either direction, hydraulic fluid must be allowed to flow from the upper chambers 92U to the lower chambers 92L. Thus a variable restricter valve VD is provided in the hosing H between the upper and lower chambers 92U, 92L. This restricter valve VD can restrict the flow of hydraulic fluid and provide a load to be worked against obviously the load to be worked against can be varied by varying the restriction caused by the restricter valve VD. A by-pass valve VE is provided across the restricter valve VD. In normal operation the by-pass valve VE will be shut but when it is desired to adjust the null height of the bar 97, the by-pass valve VE can be opened to allow free flow of hydraulic fluid from the upper to the lower chambers 92U, 92L.

In an alternative hydraulic arrangement for use with the tenth exercise device shown in FIG. 11 the hydraulic arrangement in FIG. 14 can be modified so that the restricter valve VD and the by-pass valve VE are replaced by two opposed one-way variable restricter valves. Each of these valves restricts flow in one direction but allows free flow in the other direction. These valves can then be switched manually or automatically to provide a chosen resistance to motion in only one direction at any one time.

Figure 15A:
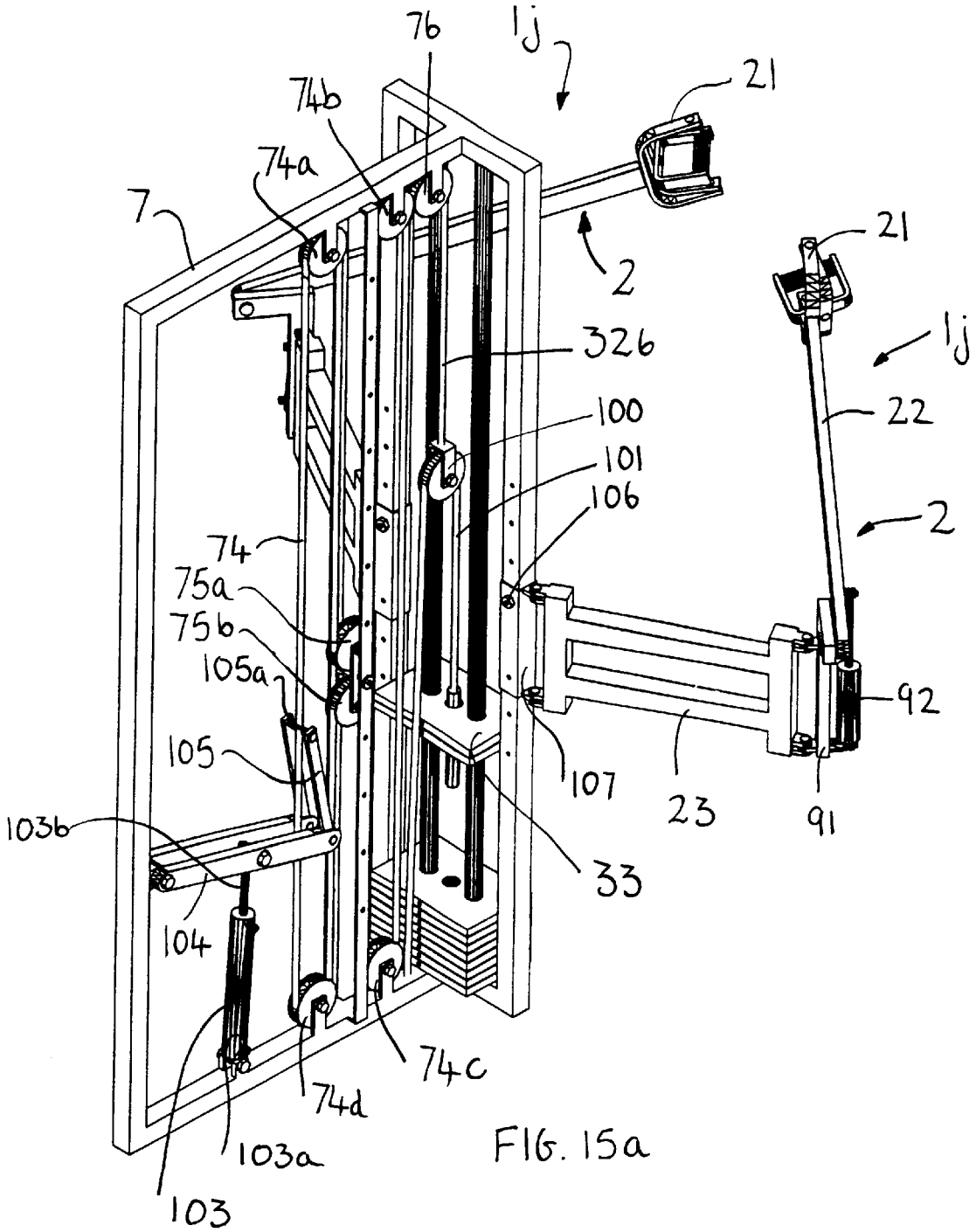
Figure 156:
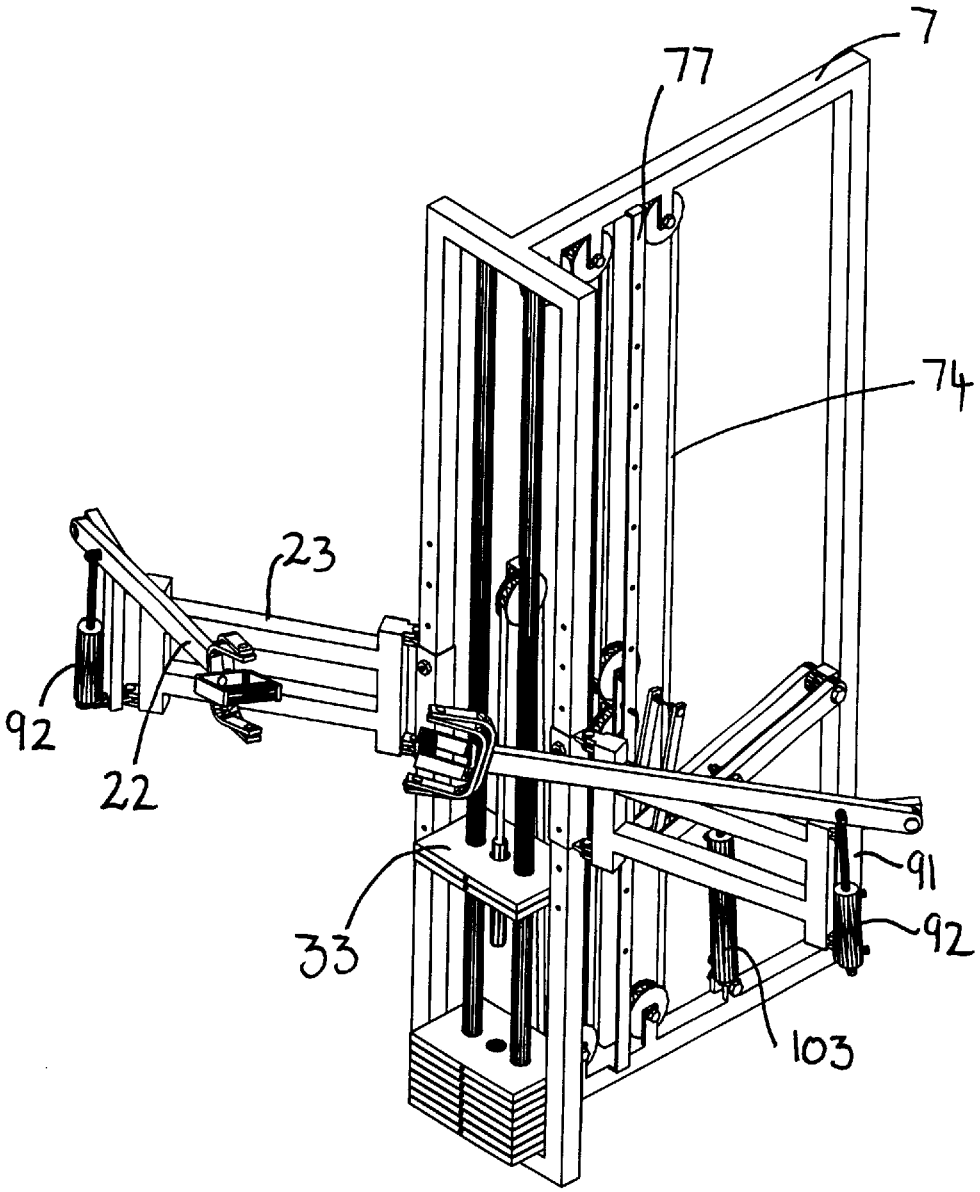
Figure 15C:
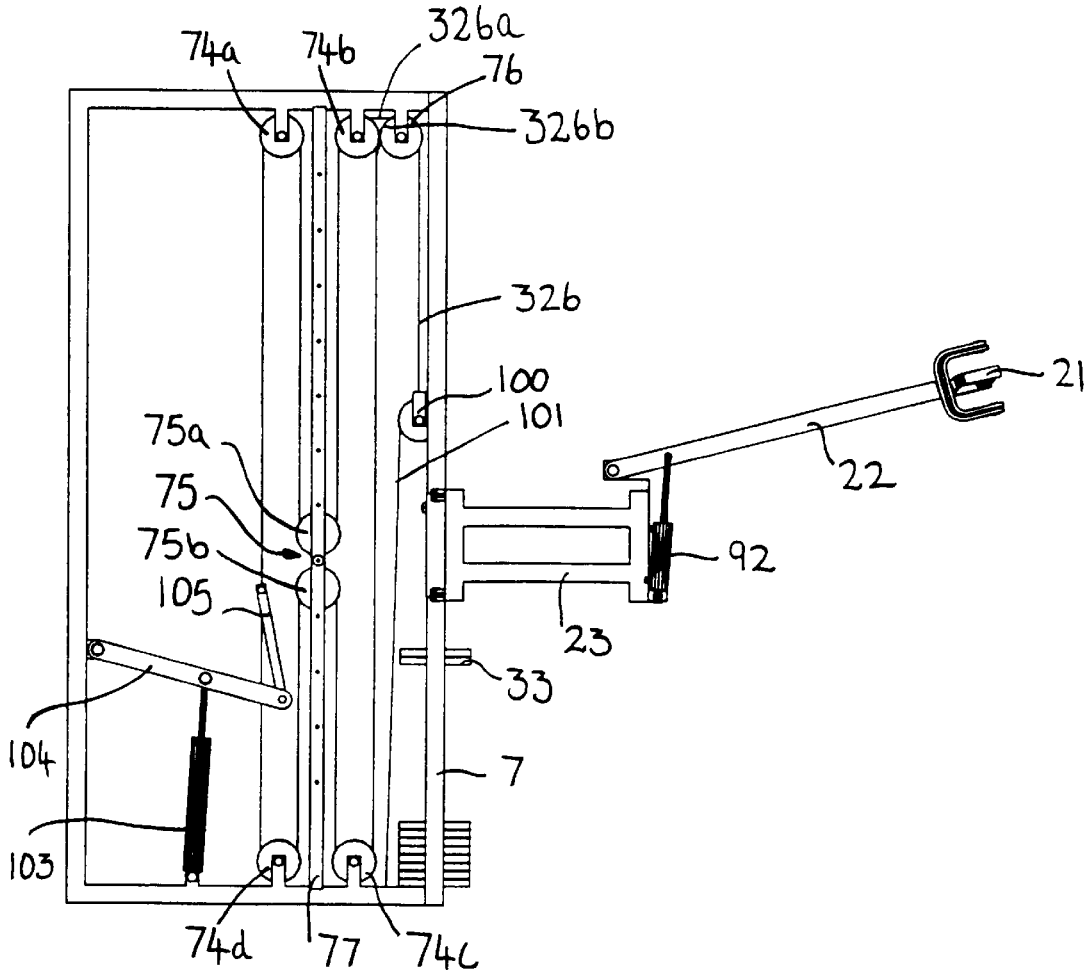
Figure 15D:
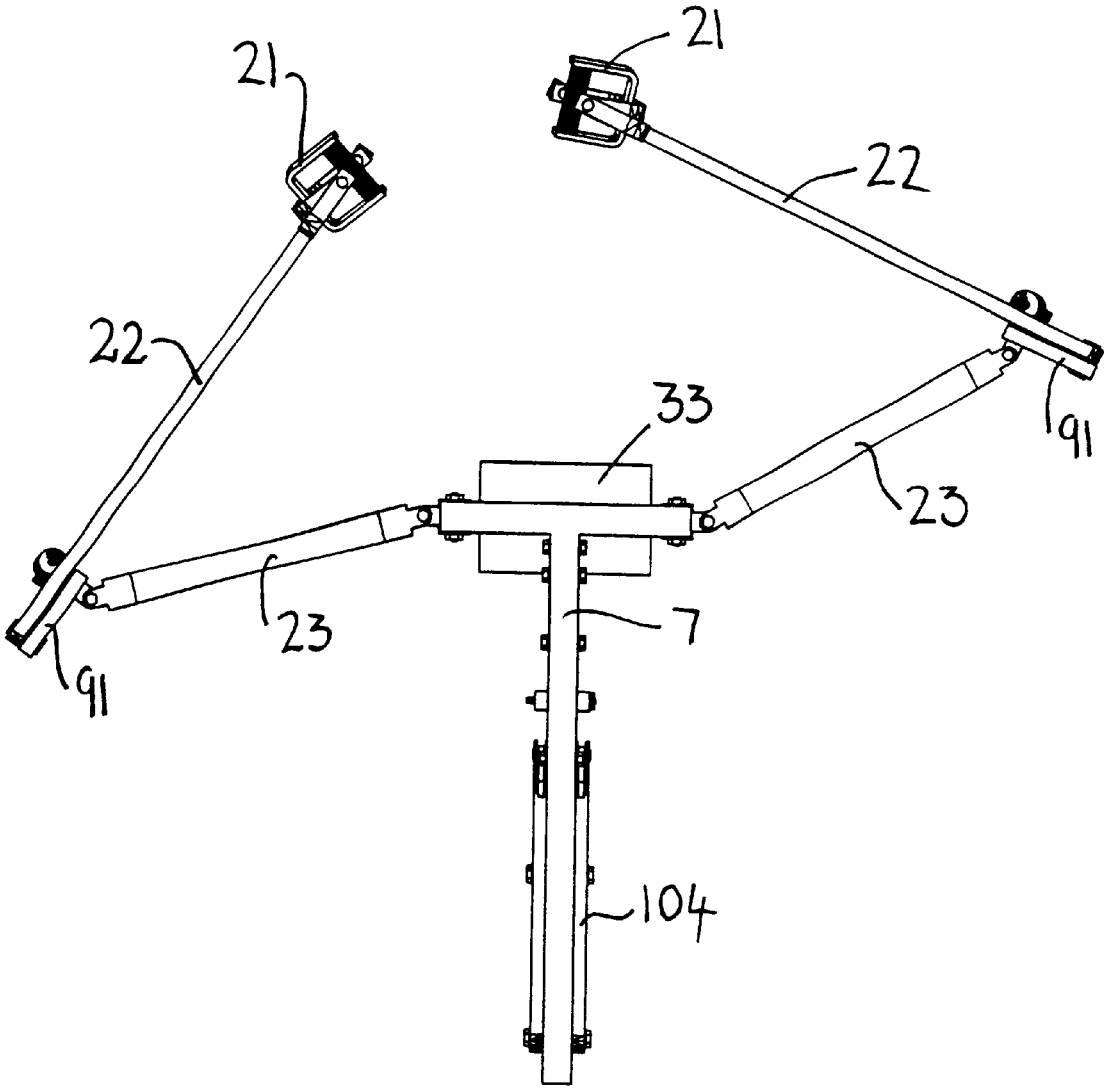

FIGS. 15*a* to 15*d* shown an eleventh exercise device which is essentially a hybrid of the sixth and seventh exercise devices. Thus the eleventh exercise device comprises two exercising units 1*j* each having a handle 21, first, second and third arm members 22, 23, 91 and an associated arm cylinder 92. These parts are configured in the same way as in the seventh exercise device described above and mounted to a frame 7. Referring particularly to FIGS. 15*a* and 15*b* the height of the connection between the second arm members 23 and the frame 7 can be adjusted by means of a sleeve 107 and pin 106 arrangement. The second arm members 23 are each mounted to a respective sleeve 107 which is mounted to the frame 7 by removable pins or bolts located in appropriate apertures.

The frame 7 of the eleventh exercise device has a different configuration to support a modified version of the loading portion 3 and pulley arrangement of the sixth exercise device. As in the sixth exercise device the eleventh exercise device has a strap loop 74 arranged around four fixed pulleys 74*a*–74*d* and a pair of moving pulley wheels 75*a* and 75*b* mounted in a moveable block 75 which is located in a rack 77. The detailed structure and functioning of this strap loop 74 is the same as in the sixth exercise device and such a description is therefore not repeated here. Similarly a weight hoisting strap 326 having first and second ends 326*a* and 326*b* is provided and attached to the strap loop 74. This weight hoisting strap 326 is arranged and operates in the same way as in the sixth exercise device except that the remote end of the weight hoisting strap 326 is not connected directly to the weight 33 but rather to a weight hoisting block 100. A further strap 101 passes over a pulley in the block 100 and has one end fixed to the frame 7 and another end fixed to the weight 33. In operation, as the weight hoisting strap 326 is moved upwards so is the weight hoisting block 100 causing the weight 33 to rise. This arrangement serves to increase the height which the weight 33 rises for a given movement of the weight hoisting strap 326.

The main difference between the structure and operation of the eleventh exercise device and the sixth exercise device is that rather than the articulated arm portion 2 sliding up and down on a guide rail and the movement being transmitted entirely by cable or straps, the first arm members 22 are pivotally moveable and movement of the first arm members 22 is transmitted via the arm cylinders 92 and associated hydraulic hosing (not shown) to a transmitting cylinder 103 provided in the frame 7. The lower chambers 92L of each of the arm cylinders 92 are connected to a lower chamber (not shown) of the transmitting cylinder 103 and the upper chambers of the arm cylinders 92U are both connected to the upper chamber (not shown) of the transmitting cylinder 103.

The casing 103*a* of the transmitting cylinder 103 is mounted directly to the frame 7, and the piston rod 103*b* is connected to a following arm 104. The following arm 104 is pivotally mounted to the frame 7 at one end and a link rod 105 is pivotally connected to another end. A remote end 105*a* of the link rod 105 is connected to the strap loop 74 in such a way that movement of the following arm can be transmitted to the strap loop 74.

The hydraulic arrangement is such that the capacity of the transmitting cylinder 103 is twice that of each of the arm cylinders 92. There is a simple hose connection between the arm cylinders 92 and the transmitting cylinder 103. Movement of the piston 92P of one or both of the arm cylinders 92 caused by movement of the first arm members 22 is transmitted by the hydraulic fluid and causes a corresponding movement of the piston (not shown) and rod 103*b* of the transmitting cylinder 103. The hydraulic system is arranged purely to transmit the effort of the exerciser to the load and is not required to introduce any element of resistance. The hydraulic arrangement and geometry of the following arm 104 and first arm members 22 is arranged so that the following arm 104 will mirror the movement of the first arm members 22 when they are moved together and will move at approximately half the speed of each arm member 22 if it is moved alone whilst keeping the other arm member 22 stationery.

In operation moving one or both first arm members 22 drives hydraulic fluid into the transmitting cylinder 103 which causes the following arm 104 to move and the vertical component of its motion is transmitted to the strap loop 74 via the link rod 105. This causes the strap loop 74 to move around its associated pulleys 74*a*–74*d*, 75*a*, 75*b* in the same way as movement of the floating block 73 in the sixth exercise device causes the strap loop 74 to move. This, in turn, causes the weight 33 to be raised by the weight hoisting member 326 as in the sixth exercise device. Thus movement of the following arm 104 and link member 105 in either direction causes the weight 33 to be raised. Correspondingly this means that movement of the first arm members 22 in either direction is resisted by gravity acting on the weight 33.

The connection points between the arm cylinders 92 and the first and third arm members 22, 91 can be chosen 10 in conjunction with the connection points between the frame 7, the transmitting cylinder 103 and following arm 104 to ensure that the correct level of mechanical advantage exists between the movement of the handle 21 and the movement of the weights 33. In this respect, in the eleventh exercise device shown in FIGS. 15*a* to *d*, the following arm 104 is approximately half the length of the first arm member 22, and consequently the weight hoisting block 100 has been introduced to double the height through which the weight is risen in order to obtain the desired mechanical advantage.

The null height of the first arm members 22 can be adjusted by moving the moveable block 75 relative to the rack 77 and fixing it in position in the same way as described in respect of the sixth exercise device.

This system has advantages of both the hydraulic and the cable based systems described above. The transmission system to the weight 33 is simplified by use of hydraulics and there is no need for hydraulic valves or switching mechanisms. This is because resistance to movement in both directions and null height adjustment are provided by means of the arrangement of the loop strap 74 and the weight hoisting pulley 326.

In any of the hydraulic arrangements where switching valves are required these can be mechanical valves, solenoid operated valves or triple stage spool valves. The valves can be manually or electrically operated.

FIG. 16 shows a handle 21 which can be used with any of the exercising units 1*a*–1*k*, described above. The grip member 212 is connected to a first end 215*a* of a first elbow member 215. A second end 215*a* of the first elbow member 215 is pivotally connected to a first end 216*a* of a second elbow member 216. A second end 216*b* of the second elbow member 216 is pivotally connected to a first end 217*a* of a third elbow member 217 while a second end 217*b* of the third elbow member 217 is pivotally connected to the first arm member 22.

Each of the elbow members 215–217 is bent through $90^3$ so that opposite ends of each elbow member are perpendicular to each other. The grip member 212 can be pivoted around two mutually perpendicular axes relative to the first arm member 22. A further degree of freedom is provided by the pivotal connection between the first elbow member 215 and the second elbow member 216. The grip member 212 and the three elbow members 215, 216, 217 are arranged and dimensioned so that a centre point C along the longitudinal length of the grip member 212 may be disposed in line with the longitudinal axis Aax of the first arm member 22 and the grip portion can be positioned perpendicularly relative to the first arm member 22.

FIG. 17 shows a handle 21 which can be used with any one of the exercising units 1*a* to 1*k*. The handle comprises a grip portion 212 fixably mounted across the mouth of a first U-shaped member 81. The first U-shaped member 81 is pivotally connected at a centre of its base portion to the centre of a base portion of a second U-shaped member 82. The second U-shaped member 82 is pivotally connected towards its free ends to the free ends of a third U-shaped member 83. The third U-shaped member 83 is connectable via a pivotal connector 84 to the end of a first arm member 22 of any of the exercising units 1*a* to 1*k* described above. As has been described with reference to FIG. 16, the grip member 212 can be pivoted around two mutually perpendicular axes relative to the first arm member 22. Also a further degree of freedom is provided by the pivotal connection between the first U-shaped member 81 and the second U-shaped member 82. Hence the grip member 212 can be orientated at a large range of angles relative to the first arm member 22 to which it is attached.

An alternative handle for the use in any of the foregoing exercising units 1*a*–1*k* can be provided. In the alternative, a grip portion is connected to a first end of a first elbow member and a second end of the first elbow member is pivotally connected to a first end of a second elbow member. A second end of the second elbow member is in turn pivotally connected to the first arm member of the arm portion. Each of the elbow members is bent through a total $90^3$ so that the first end of each of the elbow members is substantially perpendicular to the respective second end. This means that the grip member may be rotated relative to the first arm member about two mutually perpendicular axes. This is facilitated by the pivotal connection between the first and second elbow members and the pivotal connection between the second elbow member and the first arm member. The arrangement of the elbow members and the grip member is such that the grip member may be positioned in such a way that a longitudinal axis of the grip member is in line with a longitudinal axis of the first arm member.

Other forms of loading device can be used in place of weights, for example, springs, pneumatic cylinders, hydraulic cylinders or resistance bands.

The devices can be used to simulate the action of dumbbell weights by using the handles independently or to simulate the action of a barbell by joining the handles with a bar which can be straight or E-Z type. The device can be used from a standing position or while sitting or lying on a flat or incline bench in the same way that an exerciser would use free weights.

A modified form of null position adjustment means can be provided in alternative forms of the sixth and eleventh exercise devices. In the modified adjustment means the moveable block 75 is not secured in position using a rack and pin arrangement but rather the rack is dispensed with the block 75 is supported by a belt loop. One end of the belt loop is connected to an upper end of the block 75 and the other end is connected to a lower end of the block 75. The belt loop runs around two additional pulleys. One of these pulleys is mounted to an upper part of the frame 7 and the other to a lower part. The position of the pulleys is such that the belt is disposed in substantially the same position as that of the rack in the sixth and eleventh exercise devices. A Pedal operated releasable brake is provided for preventing movement of the belt loop to keep the moveable block 75 locked in one position during normal operation.

In order to adjust the null position the user operates the pedal to release the break. The first arm members 22 can then be moved without resistance to set the desired null position. The user then releases the pedal so that the brake is reapplied and the moveable block 75 is locked in the new position which corresponds to the desired null position.

It is generally desirable in most of the exercise devices described above if the first arm member 21, or the whole arm portion 2, as appropriate, is counterbalanced by other parts of the exercise device. This can be useful to prevent unwanted movement of the arm portion in certain situations, for example, if no weight 33 is in place. If the counterbalancing is neutral when no load (weight 33) is applied it is advantageous because the resistance to movement in both vertical directions will be the same. As an example, in the eleventh exercise device, the weight and geometry of the following member 104 are chosen to counterbalance the first arm member 21.

FIGS. 18 to 20 show a twelfth exercise device which generally comprises an exercising unit 1001 which comprises an arm portion 1002, a loading portion 1003 and transmitting means 1004 for transmitting movement of the arm portion 1002 to the loading portion 1003. The arm portion 1002, the loading portion 1003 and the transmitting means 1004 are all mounted to a frame 1005.

The frame 1005 comprises a number of plates 1051 which can be used to fix the frame 1005 and hence the exercise device as a whole to supporting structure which may, for example, be a wall.

The arm portion 1002 comprises a grip member 1021 which is pivotally mounted to a first arm member 1022 which in turn is pivotally mounted to a second arm member 1023 via a third arm member 1024. An end of the second arm member 1023 which is remote from the first arm member 1022 is pivotally mounted to the frame 1005.

The grip member 1021 comprises a bar 1021*a* which asses through a rod eye mounting 1021*b* which serves to connect the grip member 1021 to the first arm member 1022. The rod eye mounting 1021*b* comprises a ball mounted on the bar 1021*a* and a ring shaped socket in which the ball is located and which is rotatably mounted to the first arm member 1022. Thus the bar 1021*a* is able to rotate about its own axis with the ball freely rotating in the socket and independently pivot about a large number of axes relative to the socket by the ball moving within the socket. Further, because the socket is rotatably mounted to the first arm member 1022 the bar 1021*a* and rod eye mounting 1021*b* as a unit can be rotated about a longitudinal axis of the first arm member 1022. Thus it will be seen that the grip member 1021 has a substantial range of free-movement relative to the first arm member 1022. This range of movement includes pivotal/rotational movement about 3 perpendicular axes.

This freedom of movement between the grip member 1021 and the first arm member 1022 is important to enable an exerciser to carry out the exercises which he desires. Throughout the rest of the description of this exercise device, movement of the grip member 1021 and the first arm member 1022 as a unit will be referred to; the grip member 1021 and the first arm member 1022 constituting a moveable member. However, it will be appreciated that, at all times, it is both possible to move the grip member 1021 and the first arm member 1022 as a unit and to move the grip member 1021 relative to the first arm member 1022.

The first arm member 1022 is pivotally mounted to the third arm member 1024 about a pivot axis in a predetermined plane (the horizontal plane in the orientation shown in FIG. 18). The second arm member 1023 is pivotally mounted to the frame 1005 and the third arm member 1024 is pivotally mounted to the second arm member 1023. These latter two pivot axes are substantially mutually parallel and are substantially perpendicular to the pivot axis of the first arm member 1022. Thus, in the orientation shown in FIG. 18 the pivot axes of the second and third arm members 1023, 1024 are substantially vertical. This means that the second and third arm members 1023, 1024 can move about their respective pivot axes in the horizontal plane. This, in turn, means that the grip member 1021 and arm member 1022 as a unit, can be moved by the exerciser to a large number of different positions in the horizontal plane without causing the first arm member 1022 to pivot relative to the third arm member 1024. This freedom of movement is substantially unresisted by the exercise device and allows the exerciser to position the grip member 1021 and arm member 1022 into a desired position for commencing an exercise and/or to move the grip member 1021 and arm member 1022 horizontally during the course of an exercise.

The loading portion 1003 comprises a weight 1031 mounted on a weight-bearing member 1032 which is pivotally mounted to the frame 1005 at an end remote from the weight 1031. The weight-bearing member 1032 is mounted to the frame 1005 in such a way that the end of the weight bearing member 1032 on which the weight 1031 is mounted will tend to move downwards due to the gravity acting on the weight. It is this force which can be used to provide a force for an exerciser to work against.

The transmitting means 1004 for transmitting the force due to the weight 1031 to the grip member 1021 and first arm member 1022 as a unit, comprises a hydraulic arrangement.

The hydraulic arrangement is described below with reference to FIGS. 18 to 20 which show the exercise device as a whole including an arm hydraulic cylinder 1006 and a weight hydraulic cylinder 1007 and FIGS. 21A, B & C which schematically show more details of the hydraulic arrangement.

The arm hydraulic cylinder 1006 comprises a casing 1061 which is pivotally mounted to the third arm member 1024 and a rod 1062 which is pivotally mounted to the first arm member 1022. Referring particularly to FIG. 21A, a piston 1063 is mounted on the rod 1062 and disposed in the casing 1061 forming an upper chamber 1064 and a lower chamber 1065 within the casing 1061. Hydraulic fluid is present in both the upper and lower chambers 1064 & 1065 and movement of the rod 1062 and piston 1063 serves to drive out or draw in hydraulic fluid to or from the upper and lower chambers.

The weight cylinder 1007 comprises a casing 1071 and a rod 1072. A piston 1073 is mounted on the rod 1072 and disposed in the casing 1071 forming an upper chamber 1074 and a lower chamber 1075. Hydraulic fluid is present in both the upper and lower chambers and the withdrawal or introduction of hydraulic fluid into the upper and lower chambers will cause the piston 1073 to move.

The upper chamber 1074 of the weight cylinder 1007 is connected by hydraulic hosing H to the upper chamber 1064 of the arm cylinder 1006. Similarly the lower chamber 1075 of the weight cylinder 1007 is connected via hydraulic hosing H to the lower chamber 1065 of the arm cylinder 1006. A bypass switching valve VF and a bypass restricter valve VG are connected in series between the length of hosing H which connects the upper chambers of the weight and arm cylinders 1006, 1007 and the length of hosing H which connects the lower chambers of the weight and arm cylinders 1006, 1007.

The rod 1072 of the weight cylinder 1007 projects from both ends of the casing 1071 when the piston 1073 is at a mid-point of the casing, as shown in FIG. 21A. A cap 1076 is provided at each end of the casing 1071. Each cap 1076 comprises a blanked off tube portion 1076*a* in which the rod 1072 can freely move and a flange portion 1076*b* which is captured in a respective mounting 1077 or 1078. The cap 1076 at the upper end of the weight cylinder 1007 is captured in load bearing mounting portion 1077 which is pivotally mounted to the weight bearing member 1032. The cap 1076 at the bottom end of the weight cylinder 1007 is captured in frame mounting portion 1078 which is pivotally mounted to the frame 1005. In effect the lower end of the weight cylinder 1007 is mounted via a trunnion to the frame 1005 and the upper end of the weight cylinder 1007 is mounted via a trunnion to the weight bearing member 1032. However the caps 1076 are not fixedly attached to either the rod 1072 or the casing 1071 but rather fit over the protruding ends of the rod 1072 and are shaped so that the closed end of the tube portion 1076*a* can abut with an end of the rod 1072 and the flange portion 1076*b* can abut with an end of the casing 1071.

As shown in FIG. 21A, when the piston 1073 is centrally disposed in the casing 1071, the flange portions 1076*b* of the caps 1076 abut with opposite ends of the casing 1071. This corresponds to the weight 1031 being in its lowermost position. This is the rest position for the weight-bearing member 1032. When the grip and first arm members 1021, 1022 are disposed so as to cause the weight-bearing member 1032 to be in its rest position, the grip and first arm members 1021, 1022 can be considered to be in their rest position. No force is required to keep the grip and first arm members 1021, 1022 in this position.

FIG. 21B shows the piston 1073 displaced in an upward direction from its central position such that an extra length of rod 1072 protrudes from the upper end of the casing 1071. Thus, whilst the bottom end of the casing 1071 still abuts with the flange portion 1076*b* of the lower cap 1076 the upper end of the rod 1072 now abuts with the blank end of the tube portion 1076*a* of the upper cap 1076. The upper cap 1076 has been raised relative to the casing 1071 and the lower cap 1076. Since the upper and lower caps 1076 are pivotally mounted to the frame 1005 and the weight bearing member 1032, the position shown in FIG. 21B corresponds to the weight 1031 having been raised away from its lowermost position.

FIG. 21C shows the piston 1073 displaced downwardly from its central position in the casing 1071. In this case the upper end of the casing 1071 abuts with the flange portion 1076*b* of the upper cap 1076 and protruding lower end of the rod 1072 abuts with the blank end of the tube portion 1076*a* of the lower cap 1076. In this case again, as is explained in more detail below, the upper cap 1076 has moved upwardly relative to the lower cap 1076 and correspondingly the weight bearing member 1032 and the weight 1031 will have been raised.

In use, when the exercise device is used to perform exercises, the bypass valves VF, VG are kept in the closed position and when the grip member 1021 and first arm member 1022 are moved as a unit around the pivot axis between the first arm member 1022 and the third arm member 1024, the rod 1062 of the arm cylinder 1006 is moved relative to the casing 1061 of the arm cylinder 1006. If this movement is downwards then hydraulic fluid is forced out of the lower chamber 1065 and drawn into the upper chamber 1064. Because the bypass valves VF and VG are closed, this causes fluid to be drawn out of the upper chamber 1074 of the weight cylinder and forced into the lower chamber 1075 of the weight cylinder 1007. This will cause the piston 1073 of the weight cylinder 1007 to move from the position shown in FIG. 21A upwards to a position similar to that shown in FIG. 21B. Thus it can be seen that moving the grip member 1021 and first arm member 1022 as a unit from a rest position causes the weight to be raised. This means that movement of the grip and first arm member 1021 and 1022 must be carried out against the force acting on the weight and that once the grip and arm member 1021 and 1022 are displaced from the rest position, there is a restoring force due to the weight 1031, which tends to pull the grip and first arm member 1021 and 1022 back to the rest position. That is to say, a user must exert effort just to hold the grip and first arm member 1021 and 1022 as a unit in a stationery position which is away from the rest position.

Similarly, if the grip member 1021 and first arm member 1022 are moved as a unit upwardly, hydraulic fluid is drawn into the lower chamber 1065 of the arm cylinder and out of the upper chamber 1064. Again, because the bypass valves are closed, this will cause the piston 1073 of the weight cylinder 1007 to be forced downwards from a position shown in FIG. 21A towards a position shown in FIG. 21C. As discussed above, this causes the weight 1031 to rise so that movement of the grip member 1021 and first arm member 1022 as a unit in the upward direction is also resisted by the weight 1031. Further, once the grip and first arm members 1021 and 1022 are moved upward, away from the rest position there is a restoring force tending to move the grip and first arm members 1021 and 1022 downward, back to the rest position.

The rest position corresponds to that position shown in FIG. 21A where the piston 1073 of the weight cylinder 1007 is centrally located in the casing 1071 and the weight 1031 is at its lowermost position. In the position shown in FIG.

21A the piston 1063 of the arm cylinder is also centrally located in the casing 1061. This means that the grip member and first arm member as a unit 1021,1022 is at the centre of its range of movement. This position corresponds to the rest position of the grip member and first arm member as a unit 1021 and 1022. It is also a null position in that movement in either direction away from this rest or null position must be carried out against a force. Moreover, in this embodiment, the weight tends to return the grip and arm member as a unit 1021, 1022 to this null position.

It is the fact that the piston 1073 of the weight cylinder 1007 is centrally located in the casing 1071 and the weight 1031 is at its lowermost position that means the system is at its rest or null position. The height of the grip member and arm member as a unit 1021, 1022 at which the null position occurs can be varied by making use of the bypass valves.

The bypass valves VG,VF are provided to make adjustments of the null position and slow lowering of the weight possible 1031 and are only opened when not performing exercises. If the bypass switching valve VF and the bypass restricting valve VG are open and the grip and first arm member 1021 and 1022 is moved as a unit, in say a downwards direction, hydraulic fluid will leave the lower chamber 1065, travel through the bypass valves VF, VG and into the upper chamber 1064. This will occur without raising the weight 1031. Therefore, the system will be still at its null position in that the weight 1031 is still in its lowermost position and the piston 1073 of the weight cylinder 1007 is still central, but the grip and arm members 1021 and 1022 as a unit will be at a lower position. This is now the new rest position of the grip member 1021 and first arm member 1022 and movement in either direction away from this rest or null position will still be resisted by the weight 1033. (This is assuming that the rest position has not been chosen to be at one of the ends of travel of the grip and arm member 1021 and 1022 as a unit).

Similarly, with the bypass switching valve VF and bypass restricting VG valve open, the grip member and first arm member as a unit 1021, 1022 can be moved upwardly from a central position and the hydraulic fluid will move from the upper chamber 1064 to the lower chamber 1063 without the weight 1031 moving.

If, on the other hand, the weight 1031 is raised from its lowermost position by the exerciser using the grip 1021 with the bypass switching valve VF closed and the user then opens the bypass switching valve VF, hydraulic fluid will be able to freely move between the upper and lower chambers 1074 and 1075 of the weight cylinder 1007. This will mean that the weight 1031 can fall towards its lowermost position without the grip 1021 moving. The bypass restricter valve VG can be used to control the rate at which the weight 1031 can fall. If the bypass restricter valve VG is left fully open, once the bypass switching valve VF is opened, the hydraulic fluid will pass unimpeded between the upper and lower chambers 1074 and 1075 of the weight cylinder and the weight will fall quickly. On the other hand, if the bypass restricter valve VG is set to give some level of restriction to the flow, the weight 1031 can be made to fall in a more controlled manner.

A suitable switch means can be provided on the grip member 1021 to allow the user to operate the valves VF, VG without letting go of the grip. The valves VF, VG can be appropriately electronically controlled.

It is an important characteristic of the present exercise device that when an exerciser carries out exercises, only movements in a loading direction are resisted and movements in all other directions are substantially unresisted. In the present embodiment the loading direction can be considered to consist of the pivotal movement of grip and first arm member as a unit 1021, 1022 about the pivot axis between the first arm member 1022 and the third arm member 1024. Movement in other directions, for example, translational movement in the horizonal plane allowed by the pivots between the second arm member 1023 and the frame 1005 and the second arm member 1023 and the third arm member 1024 is substantially unresisted. Similarly, as mentioned above, the grip member 1021 is able to move freely relative to the first arm member 1022.

Further, it is desirable that the geometry of and positioning of the connection points between the arm members 1022, 1023, 1024, the hydraulic arrangement and the loading portion 1003 is such that, as the grip member 1021 and first arm member 1022 are moved as a unit about the first arm member's pivot axis, the force which must be worked against is substantially constant throughout the operational range of the grip member and first arm member. This operational range can be considered to be approximately 45° either side of a central position of the first arm member 1022.

The exercise device is also designed such that the force which must be exerted by a user at the grip 1021 in a predetermined linear direction (the vertical direction in the orientation shown in FIG. 18) does not vary significantly as the grip is moved through its operational range. That is to say, although the force which must be applied to the grip member 1021 will cause the grip and arm member 1021, 1022 to pivot around its pivot axis, the vertical component of this force does not vary significantly throughout the operational range.

Because of the design of the arm portion 1002, and in particular the provision of pivot points between the frame 1005, the second arm member 1023 and the third arm member 1024, it is possible, in most situations, for the user to move a grip member 1021 along a substantially linear path relative to the frame 1005 even though the grip member and first arm member 1021 and 1022 as a unit are pivoting around an axis. For example, as the grip member 1021 is moved upwards from the rest position, if the user wishes to move the grip member 1021 in a purely vertical direction, freedom of movement provided by the pivot between the frame 1005 and the second arm member 1023 allows him to do this.

All these features of the exercise device serve to allow the exercise device to closely mimic the feel of the use of free weights, whilst providing the added advantages of providing resistance in both upwards and downwards directions and keeping the movement of the weight controlled to enhance safety. These features and advantages are not only provided by the present exercise but can also be realised, at least to some extent, in respect of at least some of the exercise devices shown in FIGS. 1 to 17.

What is claimed is:

1. An exercise device comprising at least one exercising unit, the or each exercising unit comprising:

a member against which effort of an exerciser can be exerted, the member being moveable in any direction from a rest position; and resistance means for providing resistance to movement of the member by the exerciser in a selected substantially linear direction, wherein the resistance means is arranged to urge the member towards the rest position when the member is displaced from the rest position in a direction opposite to the selected substantially linear direction and such that there is substantially no resistance to components of movement of the member in directions which are not substantially parallel to the selected substantially linear direction, and in which the rest position is a null position and the resistance means is arranged to resist movement of the member in two directions away from the null position and to urge the member towards the null position when the member is displaced from the null position in either of said two directions.

2. An exercise device according to claim 1 in which means for adjusting the null position are provided.

3. An exercise device comprising at least one exercising unit, the or each exercising unit comprising:

a member against which effort of an exerciser can be exerted, the member being moveable in any direction from a rest position; and resistance means for providing resistance to movement of the member by the exerciser in a selected substantially linear direction, wherein the resistance means is arranged to urge the member towards the rest position when the member is displaced from the rest position in a direction opposite to the selected substantially linear direction and such that there is substantially no resistance to components of movement of the member in directions which are not substantially parallel to the selected substantially linear direction, and in which the exercise device further comprises an arm portion comprising a grip member and an arm member, the grip member being mounted to the arm member so as to allow the grip member to pivot, substantially without resistance, relative to the arm member, and wherein the member against which an exerciser can exert effort comprises the grip member.

4. An exercise device according to claim 3 in which the grip member is mounted to the arm member so as to allow the grip member to pivot about two mutually perpendicular axes relative to the arm member.

5. An exercise device according to claim 3 which the arm portion is an articulated arm portion comprising the arm member and a further arm member which are pivotally connected to one another.

6. An exercise device according to claims 3 in which the grip member and arm member as a unit is pivotally mounted about an axis.

7. An exercise device according to claim 6 in which the arm portion is arranged so that the grip member can follow a substantially linear path as the arm member and grip member as a unit are moved around said axis.

8. An exercise device comprising at least one exercising unit, the or each exercising unit comprising:

a member against which effort of an exerciser can be exerted, the member being moveable in any direction from a rest position; and resistance means for providing resistance to movement of the member by the exerciser in a selected substantially linear direction, wherein the resistance means is arranged to urge the member towards the rest position when the member is displaced from the rest position in a direction opposite to the selected substantially linear direction and such that there is substantially no resistance to components of movement of the member in directions which are not substantially parallel to the selected substantially linear direction, the resistance means comprising a weight mounted on a pivotally moveable weight bearing member and being arranged so that gravity acting on the weight provides the resistance to movement of the member.

9. An exercise device according to claim 8 in which the rest position is a null position and the resistance means is arranged to resist movement of the member in two directions away from the null position and to urge the member towards the null position when the member is displaced from the null position in either of said two directions.

10. An exercise device according to claim 9 in which means for adjusting the null position are provided.

11. An exercise device according to claim 8 in which the exercise device further comprises an arm portion comprising a grip member and an arm member, the grip member being mounted to the arm member so as to allow the grip member to pivot, substantially without resistance, relative to the arm member, and wherein the member against which an exerciser can exert effort comprises the grip member.

12. An exercise device according to claim 11 in which the grip member is mounted to the arm member so as to allow the grip member to pivot about two mutually perpendicular axes relative to the arm member.

13. An exercise device according to claim 11 in which the arm portion is an articulated arm portion comprising the arm member and a further arm member which are pivotally connected to one another.

14. An exercise device according to claim 11 in which the grip member and arm member as a unit is pivotally mounted about an axis.

15. An exercise device according to claim 14 in which the arm portion is arranged so that the grip member can follow a substantially linear path as the arm member and grip member as a unit are moved around said axis.

16. An exercise device comprising at least one exercising unit, the or each exercising unit comprising:

a member against which effort of an exerciser can be exerted, the member being moveable in any direction from a rest position; and resistance means for providing resistance to movement of the member by the exerciser in a selected substantially linear direction, wherein the resistance means is arranged to urge the member towards the rest position when the member is displaced from the rest position in a direction opposite to the selected substantially linear direction and such that there is substantially no resistance to components of movement of the member in directions which are not substantially parallel to the selected substantially linear direction, the resistance means comprising potential energy storage means for storing work done by the exerciser against the resistance means.

17. An exercise device according to claim 16 in which the rest position is a null position and the resistance means is arranged to resist movement of the member in two directions away from the null position and to urge the member towards the null position when the member is displaced from the null position in either of said two directions.

18. An exercise device according to claim 17 in which means for adjusting the null position are provided.

19. An exercise device according to claim 16 in which the exercise device further comprises an arm portion comprising a grip member and an arm member, the grip member being mounted to the arm member so as to allow the grip member to pivot, substantially without resistance, relative to the arm member, and wherein the member against which an exerciser can exert effort comprises the grip member.

20. An exercise device according to claim 19 in which the grip member is mounted to the arm member so as to allow the grip member to pivot about two mutually perpendicular axes relative to the arm member.

21. An exercise device according to claim 19 in which the arm portion is an articulated arm portion comprising the arm member and a further arm member which are pivotally connected to one another.

22. An exercise device according to claim 19 in which the grip member and arm member as a unit is pivotally mounted about an axis.

23. An exercise device according to claim 22 in which the arm portion is arranged so that the grip member can follow a substantially linear path as the arm member and grip member as a unit are moved around said axis.

24. An exercise device comprising at least one exercising unit, the or each exercising unit comprising:

a member against which effort of an exerciser can be exerted, the member being moveable in any direction from a rest position; and resistance means for providing resistance to movement of the member by the exerciser in a selected substantially linear direction, wherein the resistance means is arranged to urge the member towards the rest position when the member is displaced from the rest position in a direction opposite to the selected substantially linear direction and such that there is substantially no resistance to components of movement of the member in directions which are not substantially parallel to the selected substantially linear direction, the resistance means comprising a weight mounted on a moveable weight bearing member and being arranged so that gravity acting on the weight provides the resistance to movement of the member.

25. An exercise device according to claim 24 in which the rest position is a null position and the resistance means is arranged to resist movement of the member in two directions away from the null position and to urge the member towards the null position when the member is displaced from the null position in either of said two directions.

26. An exercise device according to claim 25 in which means for adjusting the null position are provided.

27. An exercise device according to claim 24 in which the exercise device further comprises an arm portion comprising a grip member and an arm member, the grip member being mounted to the arm member so as to allow the grip member to pivot, substantially without resistance, relative to the arm member, and wherein the member against which an exerciser can exert effort comprises the grip member.

28. An exercise device according to claim 27 in which the grip member is mounted to the arm member so as to allow the grip member to pivot about two mutually perpendicular axes relative to the arm member.

29. An exercise device according to claim 27 in which the arm portion is an articulated arm portion comprising the arm member and a further arm member which are pivotally connected to one another.

30. An exercise device according to claim 27 in which the grip member and arm member as a unit is pivotally mounted about an axis.

31. An exercise device according to claim 30 in which the arm portion is arranged so that the grip member can follow a substantially linear path as the arm member and grip member as a unit are moved around said axis.

* * * * *